US011160366B2

(12) United States Patent
Clegg et al.

(10) Patent No.: US 11,160,366 B2
(45) **Date of Patent: *Nov. 2, 2021**

(54) HEIGHT ADJUSTMENT MECHANISM

(71) Applicant: LIFETIME PRODUCTS, INC., Clearfield, UT (US)

(72) Inventors: Frank Clegg, Fruit Heights, UT (US); Baik Kwang Ho, Xiamen (CN); Leo Cai, Xiamen (CN); William Du, Xiamen (CN)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/680,235

(22) Filed: Nov. 11, 2019

(65) Prior Publication Data

US 2020/0077785 A1 Mar. 12, 2020

Related U.S. Application Data

(63) Continuation of application No. 15/942,215, filed on Mar. 30, 2018, now Pat. No. 10,470,561.

(51) Int. Cl.
*A47B 9/00* (2006.01)
*A47B 9/14* (2006.01)
(Continued)

(52) U.S. Cl.
CPC ..... *A47B 9/14* (2013.01); *A47B 3/083* (2013.01); *A47B 9/20* (2013.01)

(58) Field of Classification Search
CPC ..... Y10T 292/084; Y10T 292/0976; E05C 9/045; Y10S 292/37; A47B 9/14
(Continued)

(56) References Cited

U.S. PATENT DOCUMENTS 2,875,007 A * 2/1959 Fox ..... A47B 9/14 248/188.5
2,999,729 A * 9/1961 Semmelroth ..... E04G 1/32 108/146
(Continued)

FOREIGN PATENT DOCUMENTS

CN 202820138 U 3/2013
FR 2573467 A1 * 5/1986 ..... E05C 9/045
(Continued)

OTHER PUBLICATIONS

English Translation of Fabre (FR2573467) (Year: 2019).*
(Continued)

*Primary Examiner* — Matthew W Ing
(74) *Attorney, Agent, or Firm* — Maschoff Brennan

(57) ABSTRACT

An embodiment includes a leg height adjustment mechanism that includes a first and second latch arms, a first and second retractors, and an activator. The latch arms each include an engagement structure. The retractors each include a sloped surface and a receiving structure. The receiving structure is engaged with one of the engagement structures of the first or the second latch arms. The first latch arm extends in a first lateral direction and the second latch arm extends a second lateral direction. The second retractor is separated from the first retractor in a second lateral direction that is opposite the first lateral direction. The activator includes angled lower surfaces that are positioned outwardly relative to the sloped surfaces.

20 Claims, 13 Drawing Sheets

(51) Int. Cl.
*A47B 3/083* (2006.01)
*A47B 9/20* (2006.01)

(58) Field of Classification Search
USPC ..... 108/132, 166, 167, 169
See application file for complete search history.

(56) References Cited

U.S. PATENT DOCUMENTS 3,410,232 A * 11/1968 Bills ..... A47B 3/0912 108/146
5,432,962 A * 7/1995 Huang ..... A47D 7/02 292/124
6,578,500 B2 * 6/2003 Malizia ..... A47B 3/00 108/115
8,534,205 B1 * 9/2013 Johnson ..... A47B 13/08 108/132
8,555,789 B2 10/2013 Jin et al.
8,757,675 B2 6/2014 Loret de Mola
9,738,295 B1 * 8/2017 Horowitz ..... A47B 3/0818
10,470,561 B2 11/2019 Clegg
2007/0001559 A1 * 1/2007 Chen ..... E05C 1/14 312/223.2
2007/0284893 A1 * 12/2007 Davies ..... E05B 65/0876 292/336.3
2010/0084874 A1 * 4/2010 Yiming ..... E05B 17/0037 292/113
2010/0244465 A1 * 9/2010 de Mola ..... E05B 5/00 292/164
2012/0199050 A1 * 8/2012 Neunzert ..... A47B 3/083 108/50.11

FOREIGN PATENT DOCUMENTS

TW 201016109 4/2010
TW M4223357 9/2011

OTHER PUBLICATIONS

International Search Report and Written Opinion dated Jun. 14, 2019, in related PCT Application No. PCT/US2019/022120.
International Search Report and Written Opinion for PCT/US2019/022120 dated Oct. 15, 2020.

* cited by examiner

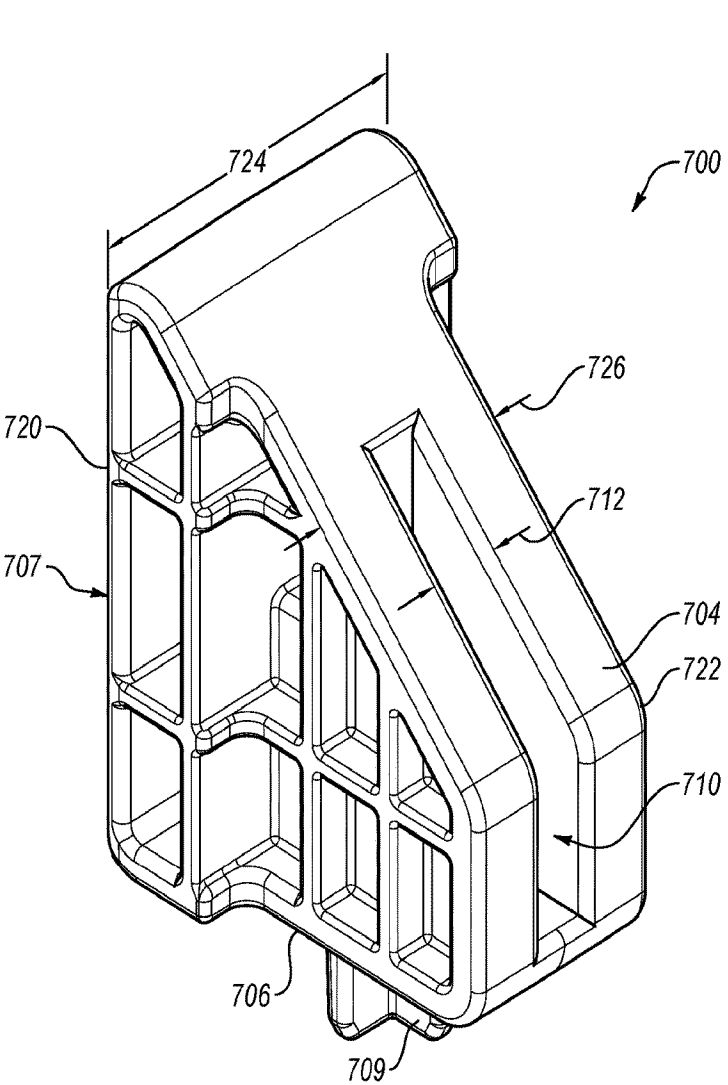
FIG. 7B
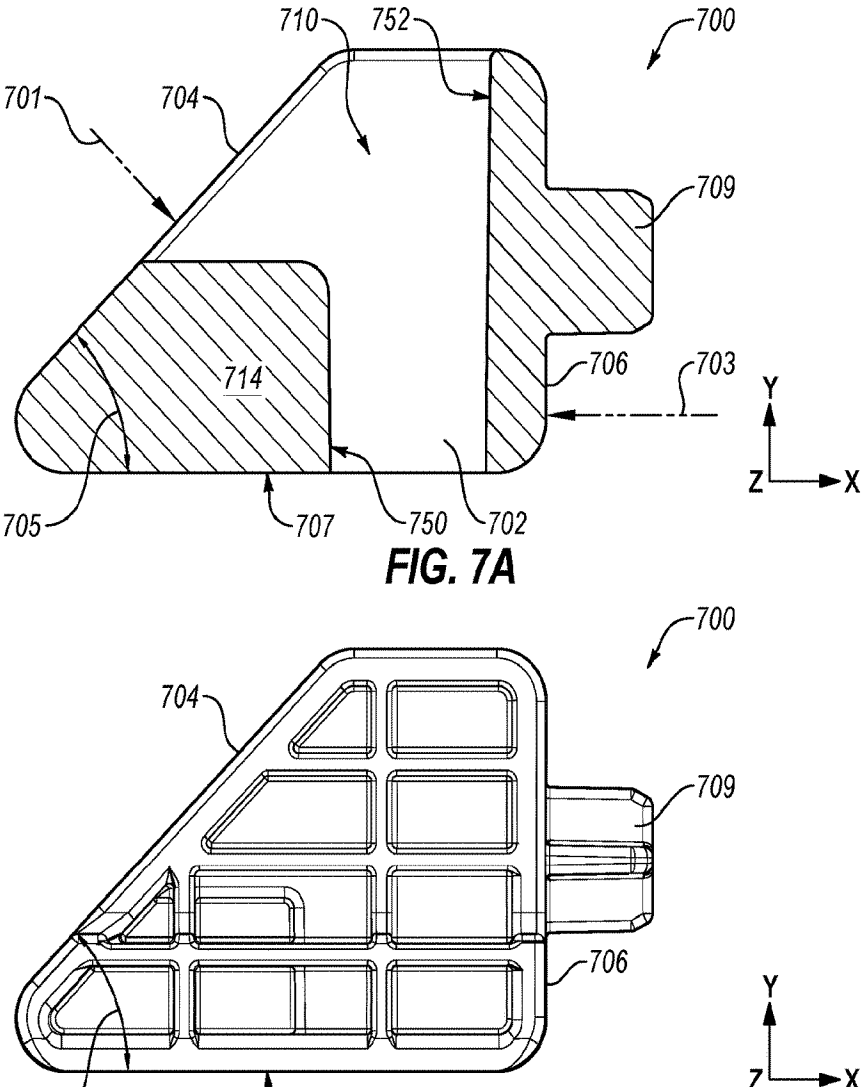
FIG. 7A
FIG. 7C

HEIGHT ADJUSTMENT MECHANISM

CROSS-REFERENCE TO RELATED APPLICATIONS

The present application is a continuation of U.S. patent application Ser. No. 15/942,215, filed on Mar. 30, 2018, now U.S. Pat. No. 10,470,561, issued Nov. 12, 2019; which is hereby incorporated by reference in its entirety.

BACKGROUND OF THE INVENTION

Field of the Invention

The present invention generally relates to tables and, in particular, to tables that may include height adjustment mechanisms.

Description of Related Art

Many different types of tables are well known and used for a variety of different purposes. For example, conventional tables may include legs that are pivotally attached to a tabletop and the legs may be movable between a use position in which the legs extend outwardly from the tabletop and a storage position in which the legs are folded against an underneath portion of the tabletop. Conventional tables with relatively large tabletops and folding legs are often referred to as "banquet tables" and these tables are frequently used in assembly halls, banquet halls, convention centers, hotels, schools, churches, and other locations where large groups of people meet. When the tables are no longer needed, the table legs can be moved into the storage position and the tables may be moved or stored.

Conventional banquet tables with movable legs may allow the tables to be more conveniently stored. The tabletop for many conventional banquet tables with movable legs, however, retains its size and shape. For example, many known banquet tables have a length between six and ten feet and a width between three and four feet. As a result, many conventional banquet tables require a large storage area even when the legs are in the collapsed position. This large storage area may be especially problematic for larger facilities such as hotels, schools, and churches because a considerable number of tables may have to be stored. Thus, a significant amount of space may be required to store the tables. In addition, smaller facilities such as restaurants, offices, and homes may use one or more conventional banquet tables. These smaller facilities may use the tables less frequently, such as during special occasions. Conventional banquet tables, even when the legs are folded, are often too bulky and awkward to be conveniently used and stored at such smaller facilities. As a result, it is often necessary for both larger and smaller facilities to rent and/or borrow banquet tables when needed. Disadvantageously, this process of renting and/or borrowing banquet tables can be inconvenient, time consuming and costly.

Conventional banquet tables are also often difficult to move or transport from one location to another. For example, because of the length of many conventional banquet tables, it is often difficult for a single person to move a table. In addition, the extended length of conventional banquet tables may preclude the tables from being transported in the trunk or back seat of a typical passenger car. Accordingly, conventional banquet tables may have to be transported by truck, trailer, or an oversized vehicle such as a sports utility vehicle. These and other factors may make conventional banquet tables difficult, time consuming, and expensive to move.

It is also known to construct tables that are capable of being folded in half. Conventional fold-in-half tables may include a tabletop with two sections pivotally connected by hinges. The two sections usually have the same size and shape, and the hinges are typically located at the center or middle of the tabletop. The two sections of the tabletop may be moved between an unfolded position in which the sections of the tabletop are generally aligned in the same plane and a folded or collapsed position in which the two sections are positioned generally adjacent to each other for storage. Moreover, some tables may include legs that may be extended or retracted. Extension and retraction of the legs may enable the legs to be stored when the table is folded or collapsed. Additionally, the extension and retraction of the legs may enable the use of the table at different heights. For instance, one table may be used for children when the legs are retracted, making the tabletop closer to a surface on which the table is placed such as the floor or the ground. Additionally, the table may be used for adults when the legs are extended, making the tabletop farther from the surface.

Disadvantageously, conventional fold-in-half tables with foldable tabletops may implement cumbersome mechanisms to change a length of the legs. These mechanisms may require the use of both hands or the table to be placed on its side to reach an activator that enables adjustment of the leg lengths. For example, some known mechanisms may include two parallel knobs or cylinders that are moved together. Such a motion may require a placement of the hand of the user in an awkward position, and may require use of the other hand to extend or retract the legs.

BRIEF SUMMARY OF EMBODIMENTS OF THE INVENTION

A need therefore exists for a table that eliminates or diminishes the disadvantages and problems described above.

One aspect of an embodiment may include a height adjustment mechanism for a table leg. The leg height adjustment mechanism may include one or more arms, retractors, and/or activators. For example, the height adjustment mechanism may include a first latch arm, a first retractor, a second latch arm, a second retractor, and an activator. The first latch arm may include a first engagement structure and the first engagement structure may be disposed on an end, such as a first end. The first retractor may include a first sloped surface and a first receiving structure that is capable of being engaged with the first engagement structure of the first latch arm such that the first latch arm extends in a first lateral direction from the first retractor. The second latch arm may include a second engagement structure and the engagement structure may be disposed on an end, such as a second end. The second retractor may be separated from the first retractor. For instance, the second retractor may be separated from the first retractor in a second lateral direction that is opposite the first lateral direction. The second retractor may include a second sloped surface and a second receiving structure that is capable of being engaged with the second engagement structure of the second latch arm such that the second latch arm extends in the second lateral direction from the second retractor. The activator may include angled lower surfaces that may be positioned outwardly relative to the first sloped surface and the second sloped surface. The angled lower surfaces may be shaped such that a translation or movement of the activator in a longitudinal direction causes the angled lower surfaces to press against or contact the first sloped surface and the second sloped surface to draw the first retractor and the second retractor towards one another. In greater detail, the activator may be configurable in an inactive position and an active position. In the inactive position, the activator may be at a first longitudinal position relative to the first retractor and the second retractor, which may enable outward translation of the first retractor and the second retractor. In the active position, the activator may be at a second longitudinal position relative to the first retractor and the second retractor, which may allow the angled lower surfaces to contact the first sloped surface and the second sloped surface, and that may cause inward translation of the first retractor and the second retractor. Additionally, at least a portion of the first and the second retractors, the activator, and the first and second latch arms may be positioned in a mechanism cavity, which may be defined by a crossbar assembly. In an exemplary embodiment, a portion of the first latch arm may extend through a first opening at a first end of the crossbar assembly when the activator is in the inactive position. In another exemplary embodiment, a portion of the second latch arm may extend through a second opening at a second end of the crossbar assembly when the activator is in the inactive position. The activator may also include a protrusion that extends from the mechanism cavity in the longitudinal direction from an upper portion of the crossbar assembly. The protrusion may include a protrusion height, which may be defined between an upper surface of the crossbar assembly and a top surface of the protrusion. The upper surface of the crossbar assembly may include an arced, curved, or rounded protrusion which may include a first end that is substantially coplanar with the upper surface and a second end that includes an arced protrusion height that is substantially coplanar to the protrusion. The second end of the arced protrusion may be positioned immediately adjacent to the protrusion. The height adjustment mechanism may further include a biasing member such as a spring. The first retractor may include a first longitudinal surface opposite the first sloped surface. The second retractor may include a second longitudinal surface opposite the second sloped surface. The spring may be positioned between the first longitudinal surface and the second longitudinal surface. The spring may be configured to provide a force to or against one or more of the retractors. For example, the spring may provide a force against the first retractor and the second retractor. In greater detail, the spring may force the first retractor from the second retractor. If desired, the spring may force the first retractor and the second retractor against the angled lower surfaces. The height adjustment mechanism may further include a first spring retainer and a second spring retainer. The first spring retainer may be positioned on the first longitudinal surface. The second spring retainer may be positioned on the second longitudinal surface. The first spring retainer and the second spring retainer may be positioned within portions of the spring. The height adjustment mechanism may further include one or more pins. In an exemplary embodiment, the height adjustment mechanism may include two pins, the activator may include two longitudinal pin apertures, and the first and second latch arms may each include a lateral pin aperture that partially overlaps one of the two longitudinal pin apertures. Each of the two pins may be positioned in one of the longitudinal pin apertures and one of the lateral pin apertures. The pins may limit motion of the activator to a substantially longitudinal direction and may limit motion of the first and second latch arms to a substantially lateral direction.

Advantageously, the height adjustment mechanism may enable the extension or retraction of table legs through application of a single force. Accordingly, the height adjustment mechanism may be actuated by a user with one hand, which may reduce effort expended when changing the height of a tabletop relative to a surface such as the ground or the floor.

Another aspect of an embodiment may include a table that includes a tabletop, a frame, a leg assembly, and a leg height adjustment mechanism. The leg height adjustment mechanism may include one or more arms, retractors, and/or activators. For example, the leg height adjustment mechanism may include a first latch arm, a first retractor, a second latch arm, a second retractor, and an activator. The first latch arm may include a first engagement structure and the engagement structure may be disposed on a first end. The first retractor may include a first sloped surface and a first receiving structure that is capable of being engaged with the first engagement structure of the first latch arm such that the first latch arm extends in a first lateral direction from the first retractor. The second latch arm may include a second engagement structure on a second end. The second retractor may be separated from the first retractor. For instance, the second retractor may be separated from the first retractor in a second lateral direction that is opposite the first lateral direction from the second retractor. The second retractor may include a second sloped surface and a second receiving structure that is capable of being engaged with the second engagement structure of the second latch arm such that the second latch arm extends in the second lateral direction from the second retractor. The activator may include angled lower surfaces that may be positioned outwardly relative to the first sloped surface and the second sloped surface. The angled lower surfaces may be shaped such that a translation or movement of the activator in a longitudinal direction causes the angled lower surfaces to press against or contact the first sloped surface and the second sloped surface to draw the first retractor and the second retractor towards one another. In detail, the activator may be configurable in an inactive position in which the activator is at a first longitudinal position relative to the first retractor and the second retractor to enable outward translation of the first retractor and the second retractor. The activator may also be configurable in an active position in which the activator is at a second longitudinal position relative to the first retractor and the second retractor and the angled lower surfaces contact the first sloped surface and the second sloped surface to cause inward translation of the first retractor and the second retractor. Additionally, the first and the second retractors, a portion of the activator, and portions of the first and second latch arms may be at least partially positioned in a mechanism cavity defined by a crossbar assembly. A portion of the first latch arm may extend through a first opening at a first end of the crossbar assembly when the activator is in the inactive position. A portion of the second latch arm may extend through a second opening at a second end of the crossbar assembly when the activator is in the inactive position. The activator may also include a protrusion that extends from the mechanism cavity in the longitudinal direction from an upper portion of the crossbar assembly. The protrusion may include a protrusion height defined between an upper surface of the crossbar assembly and a top surface of the protrusion. The upper surface of the crossbar assembly may include an arced protrusion that includes a first end that is substantially coplanar with the upper surface and a second end that includes an arced protrusion height that is substantially coplanar to the protrusion. The second end of the arced protrusion may be positioned immediately adjacent to the protrusion. The height adjustment mechanism may further include a biasing member such as a spring. The first retractor may include a first longitudinal surface opposite the first sloped surface. The second retractor may include a second longitudinal surface opposite the second sloped surface. The spring may be positioned between the first longitudinal surface and the second longitudinal surface. The spring may be configured to provide a force to or against one or more of the retractors. For example, the spring may provide a force against the first retractor and the second retractor. In greater detail, the spring may force the first retractor from the second retractor and to force the first retractor and the second retractor against the angled lower surfaces. The height adjustment mechanism may further include a first spring retainer and a second spring retainer. The first spring retainer may be positioned on the first longitudinal surface. The second spring retainer may be positioned on the second longitudinal surface. The first spring retainer and the second spring retainer may be positioned within portions of the spring. The height adjustment mechanism may further include one or more pins (e.g., two pins), the activator may include one or more longitudinal pin apertures (e.g., two longitudinal pin apertures), and the first and second latch arms may each include a lateral pin aperture that partially overlaps one of the two longitudinal pin apertures. Each of the pins may be positioned in one of the longitudinal pin apertures and one of the lateral pin apertures. The pins may limit motion of the activator to a substantially longitudinal direction and may limit motion of the first and second latch arms to a substantially lateral direction.

Yet another aspect of an embodiment may include one or more leg assemblies that may be pivotally connected to a table. For example, an embodiment may include a first leg assembly and a second leg assembly. The first leg assembly and the second leg assembly may be pivotally connected to a table. In greater detail, the leg assemblies may be pivotally connected to the frame and/or the table top. The leg assembly may include any suitable number of legs, leg assemblies, and/or leg subassemblies. For example, the leg assembly may include a first leg subassembly, a second leg subassembly, a crossbar assembly, and a height adjustment mechanism. The first leg subassembly may include a first upper leg having one or more upper latch openings and the latch openings may be disposed on an inner surface of the first upper leg. The first upper leg may at least partially define a first cavity into which a first lower leg may be retractably positioned. The lower leg may have one or more lower latch openings and one or more of the lower latch openings may be selectively aligned with the one or more upper latch openings. The second leg subassembly may include a second upper leg having one or more upper latch openings and the latch openings may be disposed on an inner surface of the second upper leg. The second upper leg may at last partially define a second cavity into which a second lower leg may be retractably positioned. The lower leg may have one or more lower latch openings and one or more of the lower latch openings may be selectively aligned with the one or more upper latch openings. The crossbar assembly may be positioned laterally between the first leg subassembly and the second leg subassembly, and may include a first opening at a first end and a second opening at a second end. The crossbar assembly may be mechanically coupled to the first upper leg and the second upper leg such that the first opening of the crossbar assembly is aligned with a first upper latch opening of the upper latch openings of the first upper leg and the second opening of the crossbar assembly is aligned with a first upper latch opening of the upper latch openings of the second upper leg. The height adjustment mechanism may be at least partially contained in the crossbar assembly and may include a first retractor, a second retractor, a first latch arm, a second latch arm, and an activator. The first retractor may include a first sloped surface and a first receiving structure. The second retractor may include a second sloped surface and a second receiving structure. The first latch arm may include a first engagement structure that is capable of being engaged with a first receiving structure of the first retractor such that the first latch arm extends in a first lateral direction from the first retractor. The second latch arm may include a second engagement structure that is capable of being engaged with the second receiving structure of the second retractor such that the second latch arm extends in a second lateral direction opposite the first lateral direction from the second retractor. The activator may include angled lower surfaces and may be configurable in an inactive position to enable outward translation of the first retractor and the second retractor such that the first latch arm and second latch arm extend from the first opening and the second opening of the crossbar assembly. The activator may be configurable in an active position in which the angled lower surfaces contact the first sloped surface and the second sloped surface to cause inward translation of the first retractor and the second retractor such that the first latch arm and the second latch arm are drawn into the crossbar assembly via the first and second openings. The activator may include a protrusion that extends from the crossbar assembly in the longitudinal direction from an upper surface of the crossbar assembly. Transition between the inactive position and the active position may include a longitudinal translation or movement of the activator relative to the crossbar assembly through application of a substantially normal force to the protrusion. The protrusion may include a protrusion height defined between the upper surface of the crossbar assembly and a top surface of the protrusion. The crossbar assembly may include two arced protrusions positioned immediately adjacent to the protrusion. Each of the two arced protrusion may include a first end that is substantially coplanar with the upper surface of the crossbar assembly and a second end that is substantially equivalent to the protrusion height. The leg assembly may also include a biasing member such as a spring. In detail, the first retractor may include a first longitudinal surface opposite the first sloped surface. The second retractor may include a second longitudinal surface opposite the second sloped surface. The spring may be positioned between the first longitudinal surface and the second longitudinal surface, and the spring may be configured to provide a force to or against one or more of the retractors. For example, the spring may provide a force against the first retractor and the second retractor. In greater detail, the spring may force the first retractor from the second retractor and to force the first sloped surface and the second sloped surface against the angled lower surfaces. The height adjustment mechanism may further include one or more pins (e.g., two pins), the activator may include one or more longitudinal pin apertures (e.g., two longitudinal pin apertures), and the first and second latch arms may each include a lateral pin aperture that at least partially overlaps one of the longitudinal pin apertures. The pins may be positioned in one of the longitudinal pin apertures and one of the lateral pin apertures. The pins may limit motion of the activator to a substantially longitudinal direction and may limit motion of the first and second latch arms to a substantially lateral direction.

Still another aspect of an embodiment may include a folding table. The folding table may include a tabletop, a frame, one or more leg assemblies, and one or more adjustment mechanisms. The tabletop may include a first tabletop section and a second tabletop section, and the table top may be movable between a folded position and an unfolded position. The first tabletop section and the second tabletop section may generally be aligned in the same plane when the tabletop is in the unfolded position. The first tabletop section and the second tabletop section may be disposed generally adjacent and parallel to each other when the tabletop is in the folded position. The frame may be connected to the tabletop and may include a first side rail and a second side rail. The first side rail may include a first rail section connected to the first tabletop section and a second rail section connected to the second tabletop section. The second side rail may include a first rail section that may be connected to the first tabletop section and a second rail section that may be connected to the second tabletop section. One or both leg assemblies may be pivotally coupled to the table. In particular, one or both leg assembly may be pivotally coupled to the frame and/or the table top. The leg assembly may include a first cross member, a first leg subassembly, a second leg subassembly, and a crossbar assembly. The first cross member may include a first end that may be disposed in the first rail section of the first side rail and a second end that may be disposed in the first rail section of the second side rail. The first leg subassembly may be coupled to the first cross member and may include a first upper leg having one or more upper latch openings. The upper latch openings may be disposed on an inner surface of the first upper leg. The first upper leg may define a first cavity into which a first lower leg may be retractably positioned. The lower leg may have one or more lower latch openings. The one or more lower latch openings may be selectively aligned with the one or more upper latch openings. Similarly, the second leg subassembly may be mechanically coupled to the first cross member. The second leg subassembly may include a second upper leg having one or more upper latch openings and the one or more upper latch openings may be disposed on an inner surface of the second upper leg. The second upper leg may at least partially define a second cavity into which a second lower leg may be retractably positioned. The lower leg may have one or more lower latch openings and the one or more lower latch openings may be selectively aligned with the one or more upper latch openings. The crossbar assembly may be positioned laterally between the first leg subassembly and the second leg subassembly. The crossbar assembly may include a first opening at a first end and a second opening at a second end. The crossbar assembly may be mechanically coupled to the first upper leg and the second upper leg such that the first opening of the crossbar assembly is aligned with a first upper latch opening of the one or more upper latch openings of the first upper leg and the second opening of the crossbar assembly is aligned with a first upper latch opening of the one or more upper latch openings of the second upper leg. The height adjustment mechanism may be at least partially contained in the crossbar assembly and may include a first retractor, a second retractor, a first latch arm, a second latch arm, a spring, and an activator. The first retractor may include a first sloped surface opposite a first longitudinal surface and a first receiving structure. The second retractor may include a second sloped surface opposite a second longitudinal surface, and a second receiving structure. The first latch arm may include a first engagement structure that may be engaged with or capable of being engaged with a first receiving structure of the first retractor such that the first latch arm extends in a first lateral direction from the first retractor. The second latch arm may include a second engagement structure that may be engaged with or capable of being engaged with the second receiving structure of the second retractor such that the second latch arm extends in a second lateral direction opposite the first lateral direction from the second retractor. The spring may be positioned between the first longitudinal surface and the second longitudinal surface and may be configured to impose a spring force that separates the first retractor from the second retractor. The activator may include angled lower surfaces that may be positioned outwardly relative to the first sloped surface and the second sloped surface. The angled lower surfaces may be configured to contact the first sloped surface and the second sloped surface. Responsive to a longitudinal translation or movement of the activator to draw the first retractor and the second retractor towards one another in a lateral direction. The activator may be configurable in an inactive position in which outward translation of the first retractor and the second retractor is enabled such that the first latch arm and second latch arm extend from the first opening of the crossbar assembly and the second opening of the crossbar assembly, respectively. The activator may be configurable in an active position that causes inward translation of the first retractor and the second retractor such that the first latch arm and the second latch arm are drawn into the crossbar assembly via the first and second openings. The activator may include a protrusion that extends from the crossbar assembly in the longitudinal direction from an upper surface of the crossbar assembly. Transition between the inactive position and the active position may include a longitudinal translation or movement of the activator relative to the crossbar assembly through application of a substantially normal force to the protrusion. The protrusion may include a protrusion height, which may be defined between the upper surface of the crossbar assembly and a top surface of the protrusion. The crossbar assembly may include two arced protrusions positioned immediately adjacent to the protrusion. One or both of the two arced protrusions may include a first end that is substantially coplanar with the upper surface of the crossbar assembly and a second end that is substantially coplanar with the protrusion. The height adjustment mechanism may further include two pins, the activator may include two longitudinal pin apertures, and the first and second latch arms may each include a lateral pin aperture that partially overlaps one of the two longitudinal pin apertures. Each of the two pins may be positioned in one of the longitudinal pin apertures and one of the lateral pin apertures. The pins may limit motion of the activator to a substantially longitudinal direction and may limit motion of the first and second latch arms to a substantially lateral direction.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of exemplary embodiments to further illustrate and clarify the above and other aspects, advantages and features of the present invention. It will be appreciated that these drawings depict only exemplary embodiments of the invention and are not intended to limit its scope. The invention will be described and explained with additional specificity and detail through the use of the accompanying drawings in which:

FIG. 7A is an enlarged, sectional side view of an exemplary retractor that may be implemented in the height adjustment mechanism of FIG. 4A;

FIG. 7B is an upper perspective view of the retractor of FIG. 7A;

FIG. 7C is a side view of the retractor of FIG. 7A;

DETAILED DESCRIPTION OF SOME EXEMPLARY EMBODIMENTS

Figure 1A:
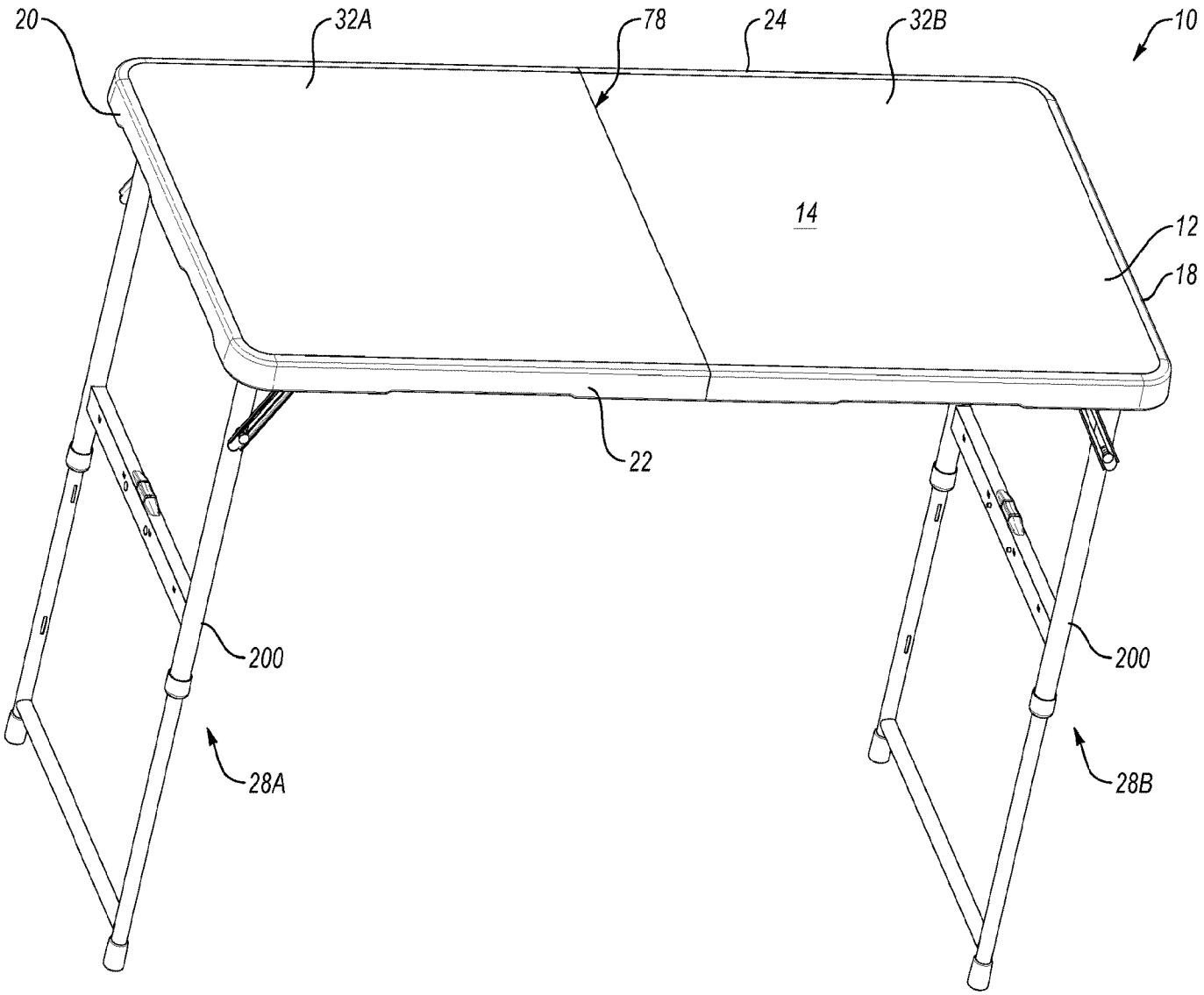
FIG. 1A is an upper perspective view of an exemplary table in an unfolded position.

The present invention is generally directed towards height adjustment mechanisms for folding tables. The principles of the present invention, however, are not limited to height adjustment mechanisms for folding tables. It will be understood that, in light of the present disclosure, the height adjustment mechanisms, tables, and features disclosed herein can be successfully used in connection with other types of tables, furniture, and the like.

Additionally, to assist in the description of the height adjustment mechanisms for tables, words such as top, bottom, front, rear, right, and left may be used to describe the accompanying figures. It will be appreciated that the height adjustment mechanisms, tables, and the like can be disposed in other positions, used in a variety of situations and may perform a number of different functions. In addition, the drawings may be to scale and may illustrate various configurations, arrangements, aspects, and features of the table. It will be appreciated, however, that the height adjustment mechanisms and/or tables may have other suitable shapes, sizes, configurations, and arrangements depending, for example, upon the intended use of the height adjustment mechanism and/or table. Further, the height adjustment mechanism and/or table may include any suitable number or combination of aspects, features and the like. A detailed description of exemplary embodiments of the height adjustment mechanisms and tables now follows.

An exemplary table 10, according to at least one embodiment, may include a tabletop 12 with an upper surface 14 (FIGS. 1A and 1D), a lower surface 16 (FIGS. 1B and 1C) a first end 18, a second end 20, a first side 22, and a second side 24. The upper surface 14 of the tabletop 12 may have a generally planar configuration and may create a working surface. The tabletop 12 may also include an edge that is disposed about the outer perimeter or periphery of the tabletop 12. All or a portion of the edge may be beveled, sloped or rounded to, for example, increase the comfort and safety of the user.

Figure 1B:
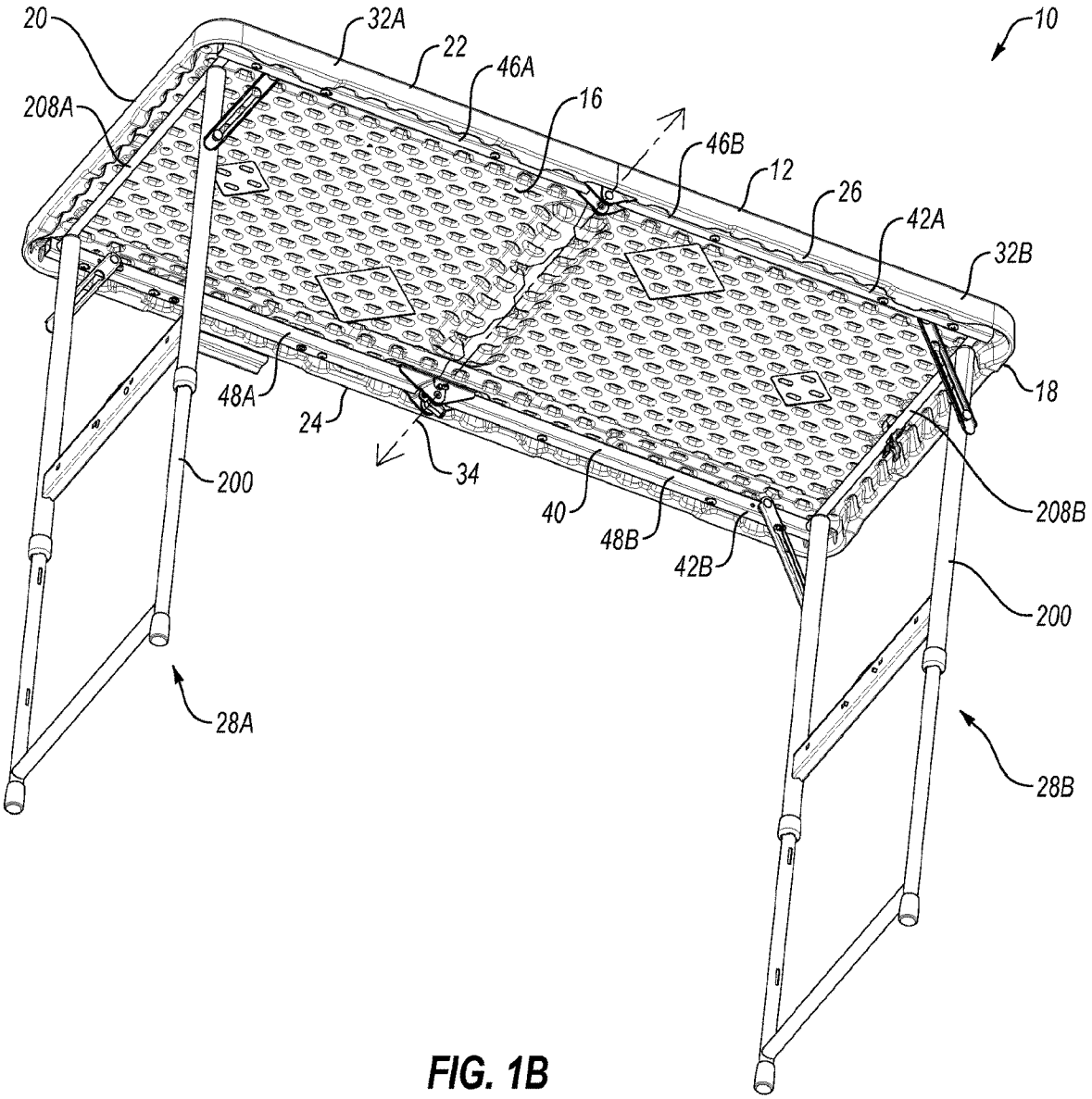
FIG. 1B is a lower perspective view of the table of FIG. 1A in the unfolded position.
Figure 1C:
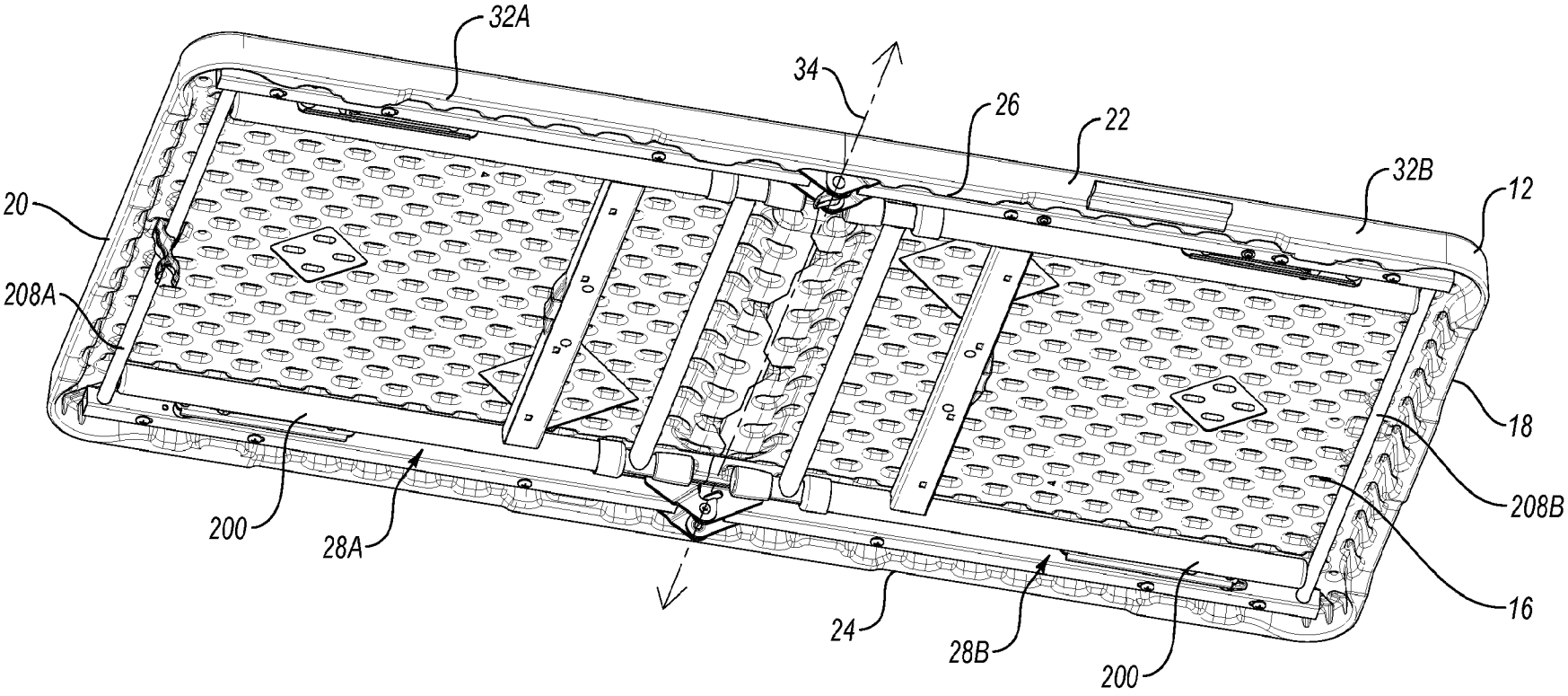
FIG. 1C is a lower perspective view of the table of FIG. 1A with leg assemblies disposed in a storage position.

As depicted in FIGS. 1B and 1C, the tabletop 12 may also include a lip 26. The lip 26 may be a downwardly extending lip 26 that is disposed near or at least proximate the outer portion or perimeter of the tabletop 12. The lip 26 may extend downwardly relative to the lower surface 16 of the tabletop 12 and the lip 26 may be aligned with or form a part of the edge of the tabletop 12. It will be appreciated that the lip 26 may also be spaced inwardly from the edge of the tabletop 12.

The tabletop 12 may have a generally rectangular configuration with rounded corners. The tabletop 12 may have a relatively large size and the table 10 may be configured for use as a banquet or utility table. For example, the tabletop 12 may have a length defined between the first end 18 and the second end 20 of about five feet (or about sixty inches) and a width defined between the first side 22 and the second side 24 of about two and one-half feet (or about thirty inches), but the tabletop 12 can be larger or smaller. For instance, embodiments of the tabletop 12 might include a length between about six and ten feet and a width of about two and three feet. One skilled in the art will appreciate the tabletop 12 can be larger or smaller; may have other suitable shapes and configurations such as square, circular, oval and the like; and the sides, corners, edges and other portions of the tabletop 12 could have various shapes, sizes, configurations and arrangements depending, for example, upon the intended use of the table. Further, the table 10 could be any suitable type of table such as a folding table, non-folding table, card table, personal table, round table, and the like. For instance, it will also be appreciated that the table 10 and its various components may have other shapes, sizes, configurations and arrangements, such as disclosed in U.S. Pat. Nos. 6,530,331; 7,111,563; 7,475,643; 7,814,844; and 7,975,625; each of which are incorporated by reference in its entirety. It will further be appreciated that the table 10 may also include any suitable number and combination of features and aspects depending, for example, upon the intended use of the table 10.

The tabletop 12 may be constructed from lightweight materials such as plastic. In particular, the tabletop 12 may be constructed from high density polyethylene but other suitable materials can be used. The tabletop 12 may be relatively strong, lightweight, rigid, and sturdy. The tabletop 12 may be quickly and easily manufactured. The tabletop 12 may also be relatively durable, weather resistant, temperature insensitive, corrosion resistant, rust resistant, and may not deteriorate or maintain structural integrity over time. The tabletop 12 could be constructed from plastics, polymers, synthetic materials and the like. The tabletop 12 could also be constructed from processes such as blow-molding, injection molding, rotational molding, rotary molding, etc. The tabletop 12 may be constructed from other materials with sufficient strength and desirable characteristics such as wood, metals, alloys, composites, fiberglass, ceramics, and the like. The tabletop 12 could be manufactured using one or more other suitable processes.

The table 10 may include one or more support structures 28A and 28B (generally, support structure 28 or support structures 28). The support structures 28 may be sized and configured to support the tabletop 12 above a surface (not shown). For example, the table 10 may include a first support structure 28A and a second support structure 28B. The support structures 28 may include one or more leg assemblies 200. Some additional details of the leg assemblies 200 are provided elsewhere in the present disclosure.

The support structures 28 may be movable between an extended or use position, which is depicted in FIGS. 1A and 1B, and a collapsed or storage position, which is depicted in FIG. 1C. In the extended or use position of FIGS. 1A and 1B, the leg assemblies 200 may extend outwardly from the tabletop 12. In the collapsed or storage position of FIG. 1C, the leg assemblies 200 may be disposed adjacent or at least proximate the lower surface 16 of the tabletop 12. Although, FIGS. 1A-1D depict the table 10 that includes two support structures 28. In some embodiments, the table 10 may include any suitable number, shape, size, configuration, and arrangement of support structures 28 depending, for example, upon the intended use of the table 10.

Figure 1D:
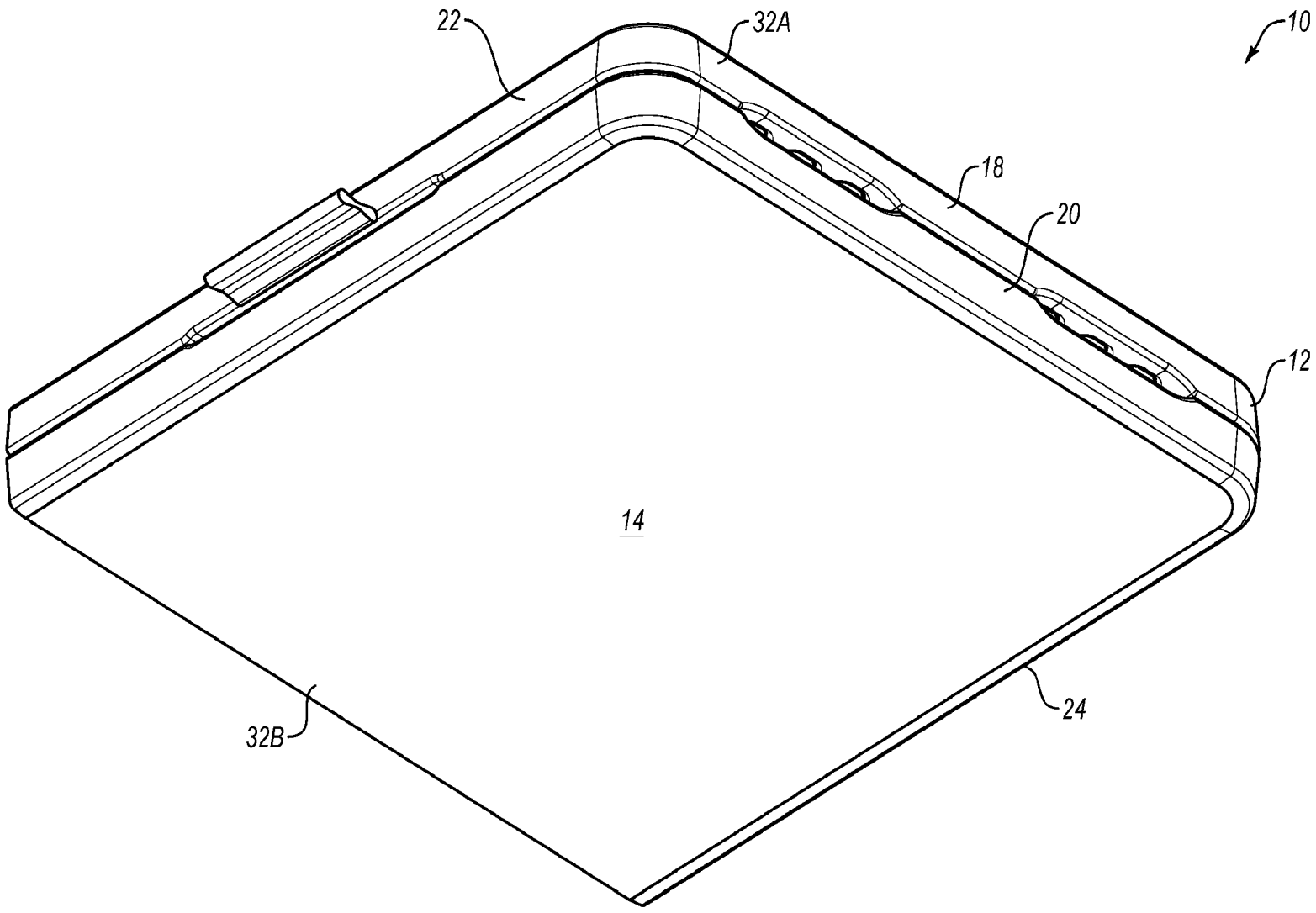
FIG. 1D is a perspective view of the table of FIG. 1A in a folded position.

The table 10 may be a folding table. The tabletop 12 may include a first tabletop section 32A and a second tabletop section 32B. The first support structure 28A may be movable between the extended and collapsed positions relative to the first tabletop section 32A. The second support structure 28B may be movable between the extended and collapsed positions relative to the second tabletop section 32B. The first and second tabletop sections 32A and 32B may be rotatable about an axis of rotation 34 ("axis 34") (see, e.g., FIGS. 1B and 1C) between an unfolded position, which is depicted in FIGS. 1A-1C, and a folded position, which is depicted in FIG. 1D.

When the tabletop 12 is in the unfolded position of FIGS. 1A-1C, the first and second tabletop sections 32A and 32B may be generally aligned in the same plane. When the tabletop 12 is in the folded position of FIG. 1D, the first and second tabletop sections 32A and 32B may be disposed generally adjacent and parallel to each other. In addition, in the folded position of FIG. 1D, some or all the components (e.g., 28 and 200) may be positioned between the first and second tabletop sections 32A and 32B.

The first and second tabletop sections 32A and 32B may have a generally rectangular configuration with a symmetrical or mirror-image configuration. In the unfolded position, the first and second tabletop sections 32A and 32B may meet at an interface 78 (FIG. 1A). In some embodiments, the first tabletop section 32A and the second tabletop section 32B may include inner surfaces that are in contact or are adjacent to create the interface 78. The inner surface of the first tabletop section 32A may be sized and configured to contact and/or engage the inner surface of the second tabletop section 32B when the tabletop 12 is in the unfolded position (FIGS. 1A-1C). The inner surfaces may then be spaced apart when the tabletop 12 is in the folded position. The inner surfaces of the tabletop 12 may include one or more interlocking, overlapping, and/or intertwined portions, such as engaging and receiving portions, which may provide additional strength, stability, and/or rigidity to at least a center portion of the tabletop 12. The tabletop 12 may also have other shapes, sizes, configurations, and arrangements. For example, the tabletop 12 may be similar to one or more of the tabletops shown in U.S. Pat. No. 7,096,799, which is incorporated by reference in its entirety.

Referring to FIG. 1B, the table 10 may further include a frame 40 that is connected to the tabletop 12. The frame 40 may include a surface that contacts or is disposed at least proximate the lower surface 16 of the tabletop 12. The frame 40 may include one or more side rails 42A and 42B (generally, side rail 42 or side rails 42). In particular, the embodiment of FIG. 1B includes a first side rail 42A and a second side rail 42B, which may extend along the length of the tabletop 12. The side rails 42 are preferably positioned near opposing edges and/or sides 22 and 24 of the tabletop 12. For example, the side rails 42 may be disposed at least proximate the lip 26 and there may be a gap or space between the side rails 42 and the lip 26. The side rails 42 preferably extend almost the entire length of the tabletop 12, which may provide increased strength and rigidity for the tabletop 12. Alternatively, the side rails 42 may extend along only a portion of the tabletop 12.

In greater detail, the first side rail 42A may be disposed towards the first side 22 of the tabletop 12. The first side rail 42A may include a first rail section 46A that is connected to the first tabletop section 32A of the tabletop 12 and a second rail section 46B connected to the second tabletop section 32B of the tabletop 12. The first and second rail sections 46A and 46B of the first side rail 42A may be offset or spaced apart. For example, the first rail section 46A may be offset from the second rail section 46B in the z-direction in the exemplary coordinate system of FIGS. 1A-1D.

The second side rail 42B may be disposed towards the second side 24 of the tabletop 12. The second side rail 42B may include a first rail section 48A connected to the first tabletop section 32A of the tabletop 12 and a second rail section 48B connected to the second tabletop section 32B of the tabletop 12. The first and second rail sections 48A and 48B of the second side rail 42B may be offset or spaced apart. For example, the first rail section 48A may be offset from the second rail section 48B in the z-direction.

The support structures 28 may be connected to the frame 40. For example, a first cross member 208A may connect the frame 40 and the first support structure 28A and a second cross member 208B may connect the frame 40 and the second support structure 28B.

Ends of the first and second cross members 208A and 208B may be disposed at least partially in openings in the side rails 42 of the frame 40, which may allow the first and second cross members 208A and 208B to rotate relative to the frame 40. The first and second cross members 208A and 208B may form part of the frame 40 and/or the support structures 28, depending, for example, upon the particular arrangement and/or configuration of the table 10. For example, referring to FIGS. 1C and 1D, transitioning the support structures 28 from the extended or use position of FIGS. 1A and 1B to the collapsed or storage position of FIG. 1C may include rotation of the support structures 28 relative to the frame 40.

Figure 2A:
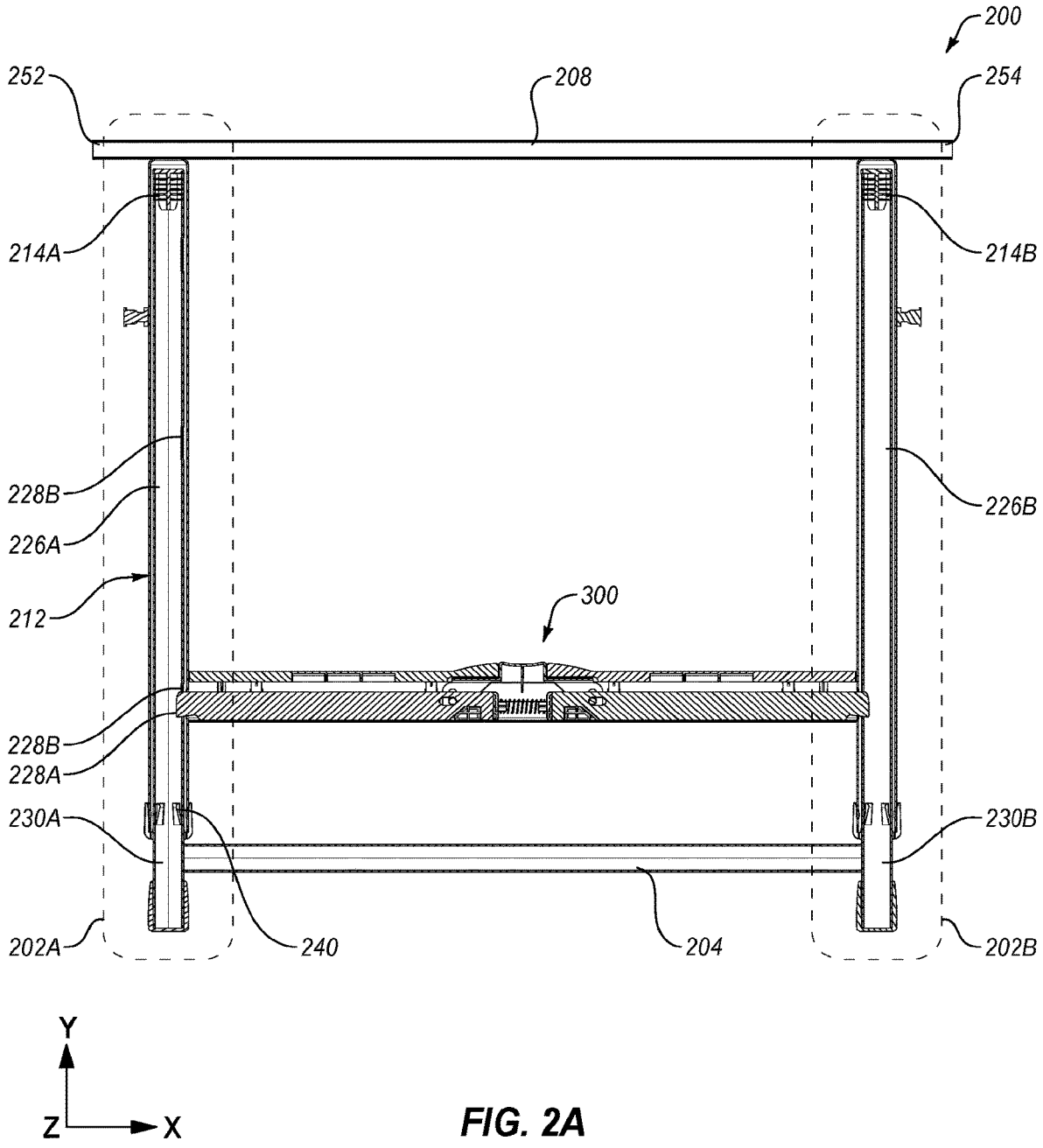
FIG. 2A is a partially cutaway side view of an exemplary leg assembly in a retracted configuration that may be implemented in the table of FIGS. 1A-1D.
Figure 2B:
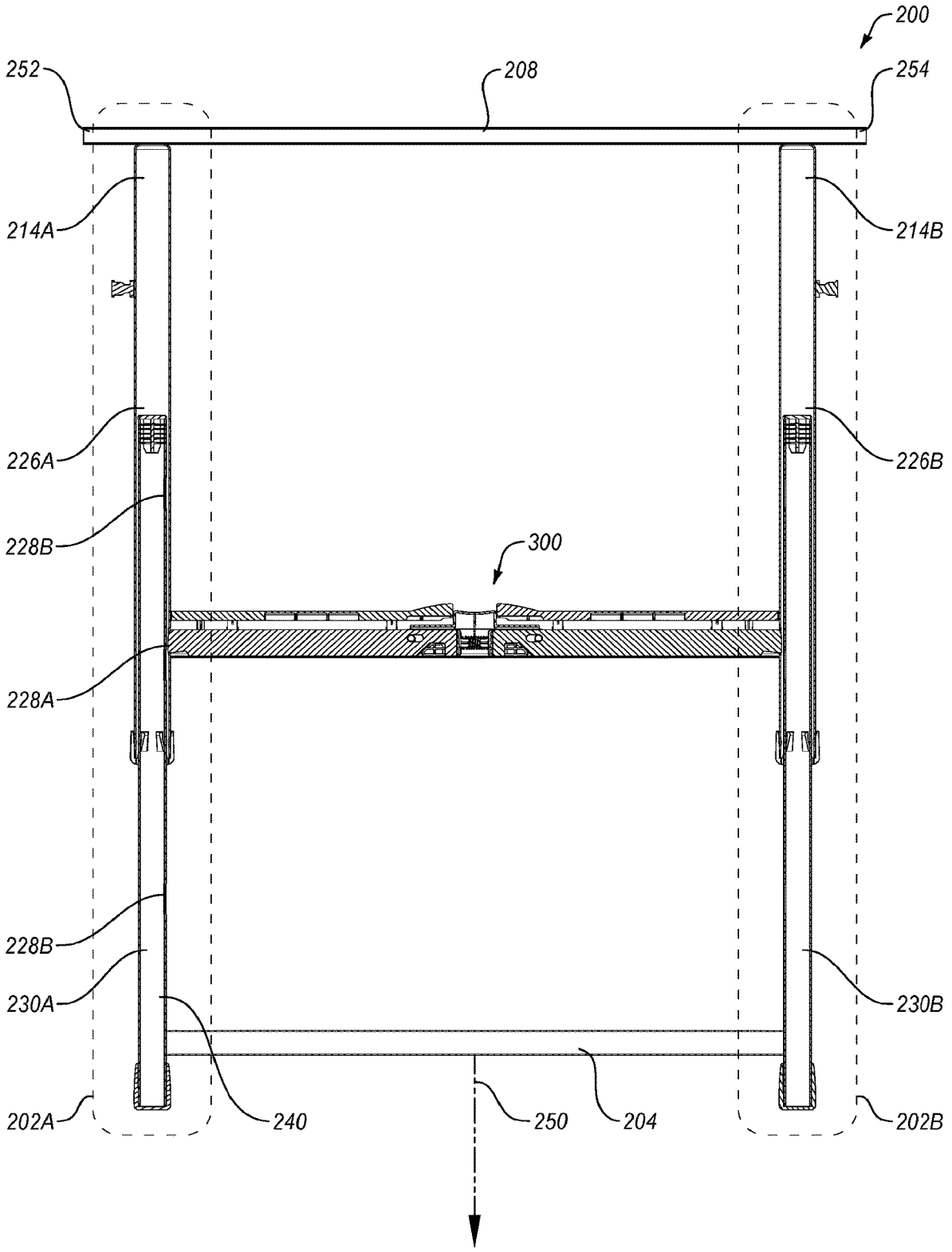
FIG. 2B illustrates the leg assembly of FIG. 2A in a transitional configuration between the retracted configuration and an extended configuration.
Figure 2C:
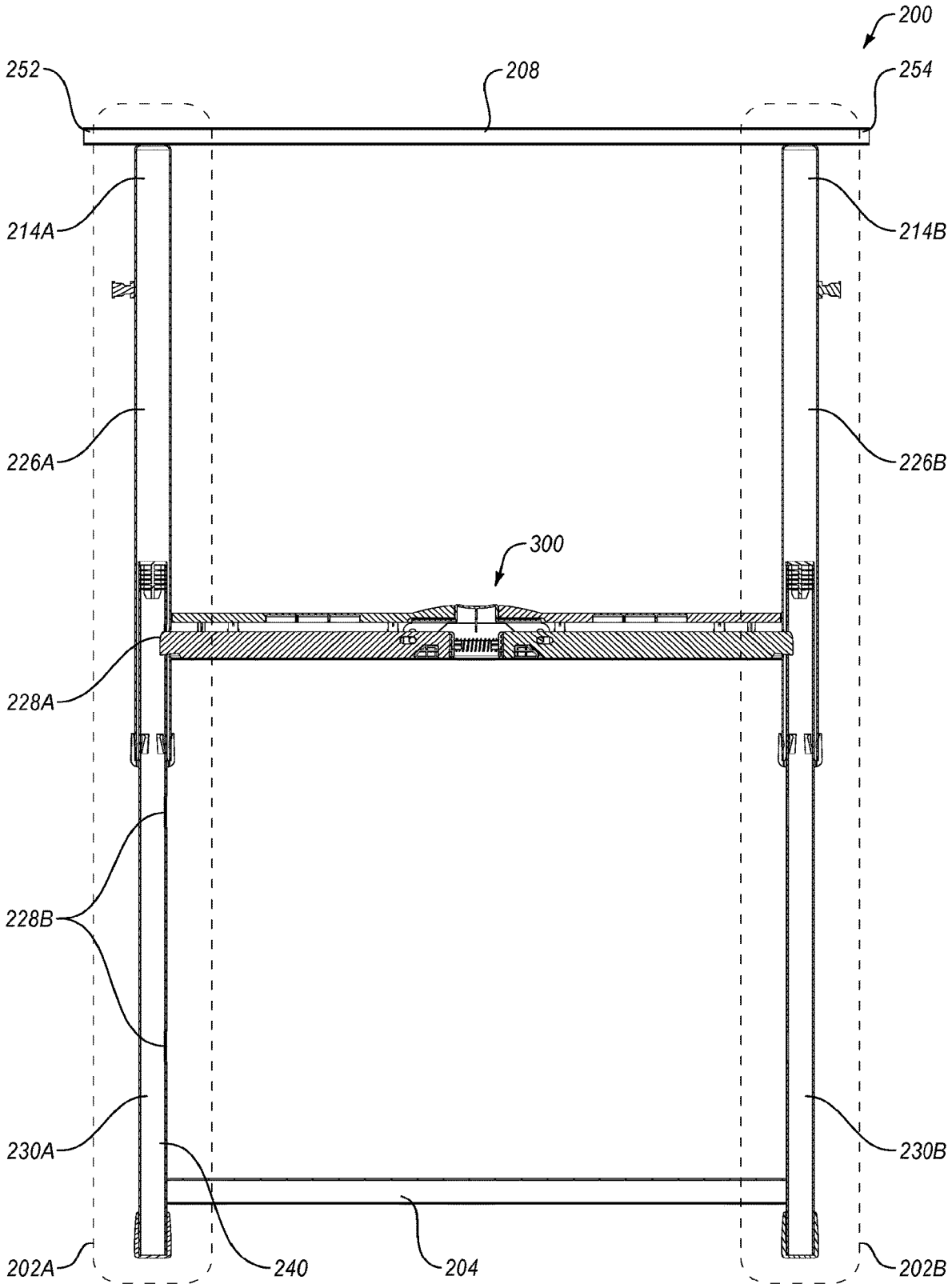
FIG. 2C illustrates the leg assembly of FIG. 2A in the extended configuration.

FIGS. 2A-2C illustrate an exemplary embodiment of the leg assembly 200 that may be implemented in the table 10. The leg assembly 200 may be pivotally connected to the table 10. For instance, the leg assembly 200 may be pivotally connected to the frame 40 and/or the tabletop 12 of the table 10. FIG. 2A depicts the leg assembly 200 in a retracted configuration. FIG. 2C depicts the leg assembly 200 in an extended configuration. FIG. 2B depicts the leg assembly 200 in a transitional configuration between the retracted configuration of FIG. 2A and the extended configuration of FIG. 2C.

The leg assembly 200 may include a first leg subassembly 202A and a second leg subassembly 202B (generally, leg subassemblies 202 or leg subassembly 202) that may be connected via a crossbar assembly 300, a first cross member 208A, and a lower crossbar 204. The first leg subassembly 202A may include a first upper leg 226A. The first upper leg 226A may at least partially define a first cavity 214A. A first lower leg 230A may be retractably positioned in the first cavity 214A. Similarly, the second leg subassembly 202B may include a second upper leg 226B. The second upper leg 226B may at least partially define a second cavity 214B. A second lower leg 230B may be retractably positioned in the second cavity 214B. The first upper leg 226A and the second upper leg 226B may be collectively or generally referred to as upper leg 226 or upper legs 226. The first lower leg 230A and the second lower leg 230B may be collectively or generally referred to as lower leg 230 or lower legs 230.

With reference to FIG. 2A, the upper legs 226 may include one or more upper latch openings 228A. The upper latch opening 228A may be disposed in an inner surface 212 of the upper legs 226. In the depicted embodiment, the upper legs 226 may include a single upper latch opening 228A. The crossbar assembly 300 may be mechanically coupled to the upper legs 226 at the inner surface 212. The crossbar assembly 300 may be mechanically coupled on the inner surface 212 at a location of the upper latch opening 228A. In particular, the crossbar assembly 300 may be mechanically coupled to the inner surface 212 such that latch arms of a table leg adjustment mechanism ("adjustment mechanism") contained or partially contained in the crossbar assembly 300 may be aligned with the upper latch openings 228A.

With reference to FIG. 2C, the lower legs 230 may include one or more lower latch openings 228B. The lower latch openings 228B may be positioned on inner surfaces 240 of the lower legs 230. One or more of the lower latch openings 228B may be selectively aligned with one or more of the upper latch openings 228A. For instance, the lower latch openings 228B may be separated in the y-direction along the inner surface 240. Accordingly, as the lower legs 230 are retracted or extended from the upper legs 226, the lower latch openings 228B may be aligned with the upper latch openings 228A.

The height adjustment mechanism may be configurable in an inactive configuration, which is depicted in FIGS. 2A and 2C. In the inactive configuration, portions of the latch arms may be disposed in the upper latch openings 228A and the lower latch openings 228B, which may be substantially aligned through extension or retraction of the lower legs 230 relative to the upper legs 226.

The height adjustment mechanism may also be configurable in an active configuration, which is depicted in FIG. 2B. In the active configuration, portions of the latch arms may be withdrawn from the lower latch openings 228B or both the lower latch openings 228B and the upper latch openings 228A. The lower legs 230 may accordingly be able to retract or extend relative to the upper legs 226 because the latch arms of the height adjustment mechanism are not positioned in the lower latch openings 228B. When the lower legs 230 are positioned at a desired location, the height adjustment mechanism may be configured in the inactive configuration in which the latch arms are positioned in the upper latch openings 228A and the lower latch openings 228B. Accordingly, the lower legs 230 are secured relative to the upper legs 226.

In some embodiments, the first cavity 214A and the second cavity 214B may be sized such that the lower legs 230 may move substantially in the y-direction relative to the upper legs 226 under its weight. For example, with reference to FIGS. 1A-1D and 2A-2C, when the table 10 is being configured for use, the table 10 may transition from the folded position of FIG. 1D to the unfolded position of FIG. 1C. The leg assemblies 200 may then be rotated from the storage position of FIG. 1C to a use position of FIG. 1B. The user may then position the table 10 on a surface, with the lower legs 230 retracted into the cavities 214A and 214B. The user may then apply a force to the height adjustment mechanism to transition the height adjustment mechanism from the inactive position to an active position (e.g., to withdraw the latch arms from the lower latch openings). The user may then lift one side (e.g., 32A or 32B) of the table 10 including the leg assembly 200 in the active configuration. The lower legs 230 may fall towards the surface without application of a force to the lower legs 230. A force may also be applied to position the lower legs 230 in a desired location. The user may then withdraw the force from the height adjustment mechanism, to configure the height adjustment mechanism in the inactive configuration, which may lock or engage the height adjustment mechanism to prevent further motion of the lower legs 230 relative to the upper legs 226.

Referring to FIGS. 1B and 2C, the first cross member 208 may include a first end 252 and a second end 254. The first end 252 may be disposed in the first rail section 46A of the first side rail 42A and the second end 254 may be disposed in the first rail section 48A of the second side rail 42B. Alternatively, the first end 252 may be disposed in the second rail section 46B of the first side rail 42A and the second end 254 may be disposed in the second rail section 48B of the second side rail 42B. The leg assembly 200 may accordingly rotate relative to the first side rail 42A and second side rail 42B, which may enable transition of the leg assemblies 200 from the storage position of FIG. 1C and the use position of FIGS. 1A and 1B.

Figure 3A:
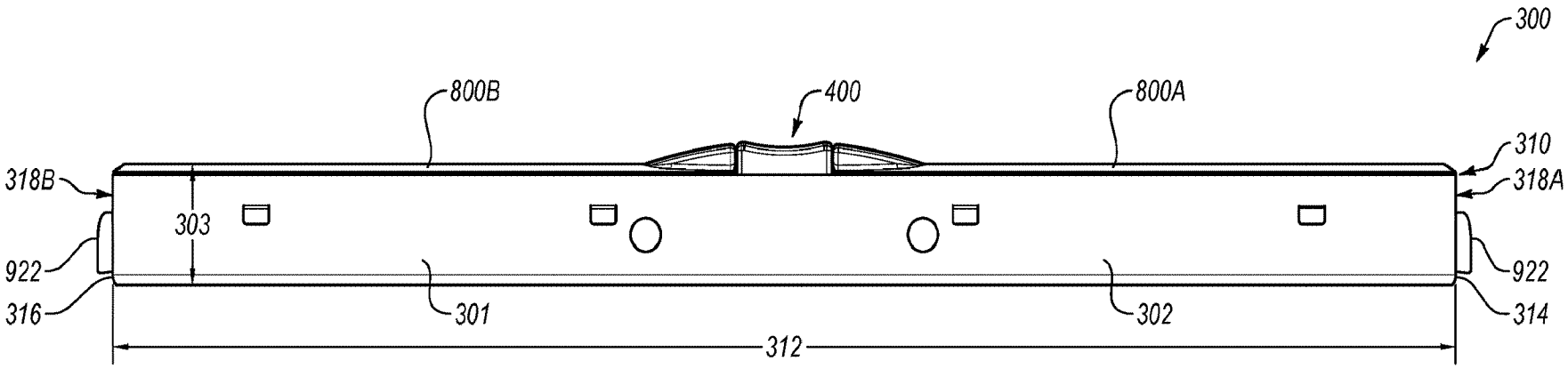
FIG. 3A is an exemplary crossbar assembly that may be implemented in the table of FIGS. 1A-1D in an inactive configuration.
Figure 3B:
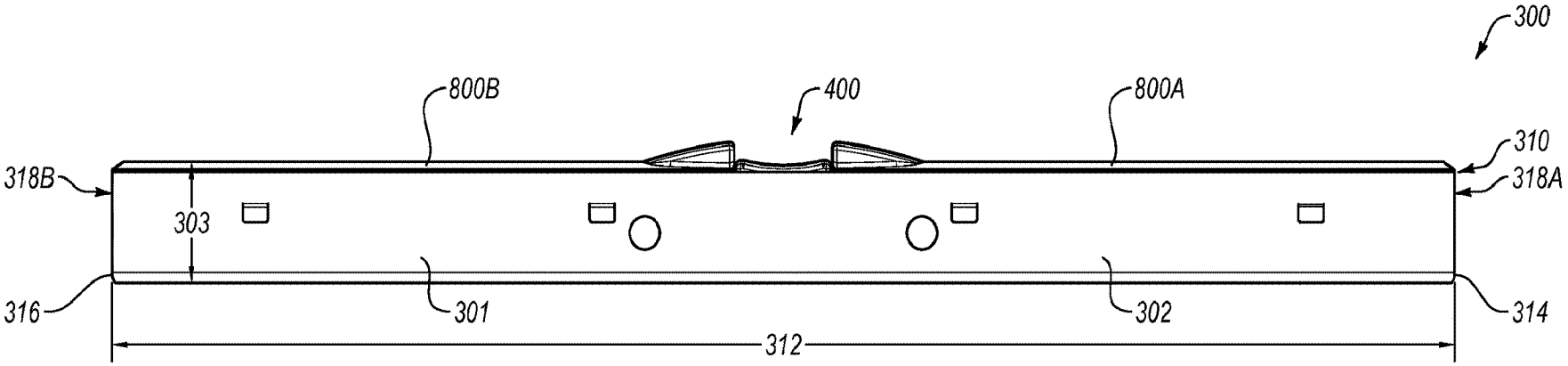
FIG. 3B illustrates the crossbar assembly of FIG. 3A in an active configuration.

FIG. 3A is an exemplary embodiment of the crossbar assembly 300 that may be implemented in the table 10 and/or in the leg assembly 200. In FIG. 3A, the crossbar assembly 300 is depicted in an inactive configuration. FIG. 3B illustrates the crossbar assembly 300 in an active configuration.

The crossbar assembly 300 may include a crossbar housing 301, which may include a shell 302 and upper crossbar portions 800A and 800B of the crossbar housing 301. The upper crossbar portions 800A and 800B are referred to generally as "upper crossbar portions 800" or "upper crossbar portion 800." The crossbar housing 301 may define at least a portion of a mechanism cavity 310. The mechanism cavity 310 may be configured to house and contain one or more components of a height adjustment mechanism 400 or portions thereof. Some additional details of the height adjustment mechanism 400 are provided elsewhere in the present disclosure. The shell 302 may include a shell length 312 between a first end 314 and a second end 316. The shell length 312 may be sized relative to a leg assembly. For example, the shell length 312 may be sized such that the crossbar housing 301 may be mechanically coupled to a first leg at the first end 314 and to a second leg at the second end 316. For instance, with combined reference to FIGS. 3A and 2A, the shell length 312 may be sized such that the first upper leg 226 is mechanically coupled to the first end 314 and the second upper leg 226 is mechanically coupled to the second end 316.

Referring back to FIGS. 3A and 3B, the crossbar housing 301 may be open at the first end 314 and the second end 316 or may define openings 318A and 318B at the first end 314 and the second end 316. The openings 318A and 318B may be aligned with latch openings on legs to which the crossbar housing 301 is attached. For instance, with combined reference to FIGS. 3A and 2A, the openings 318A and 318B may be aligned with the latch openings 228A and 228B included in the first upper leg 226A and the second upper leg 226B to which the crossbar housing 301 is mechanically coupled.

As shown in FIG. 3A, the height adjustment mechanism 400 may be contained in the crossbar housing 301 and the height adjustment mechanism 400 may be configured in an inactive configuration. In the inactive configuration, latch portions 922 may extend from the crossbar housing 301. With the latch portions 922 extended from the crossbar housing 301, the latch portions 922 may be disposed in and/or engaged with a latch opening included in legs to which the crossbar housing 301 is mechanically attached. When the latch portions 922 are disposed in and/or engaged with the latch openings, the latch portions 922 may prevent retraction or extension of leg portions (e.g., the lower leg 230) relative to other leg portions.

As shown in FIG. 3B, the height adjustment mechanism 400 contained in the crossbar housing 301 may be configured in an active configuration. In the active configuration, the latch portions 922 may be drawn into the crossbar housing 301. With the latch portions 922 drawn into the crossbar housing 301, the latch portions 922 may be disengaged from the latch opening included in legs to which the crossbar housing is mechanically attached. When the latch portions 922 are disengaged from the latch openings, the leg portions (e.g., the lower leg 230) may be retracted or extended relative to other leg portions.

Figure 4A:
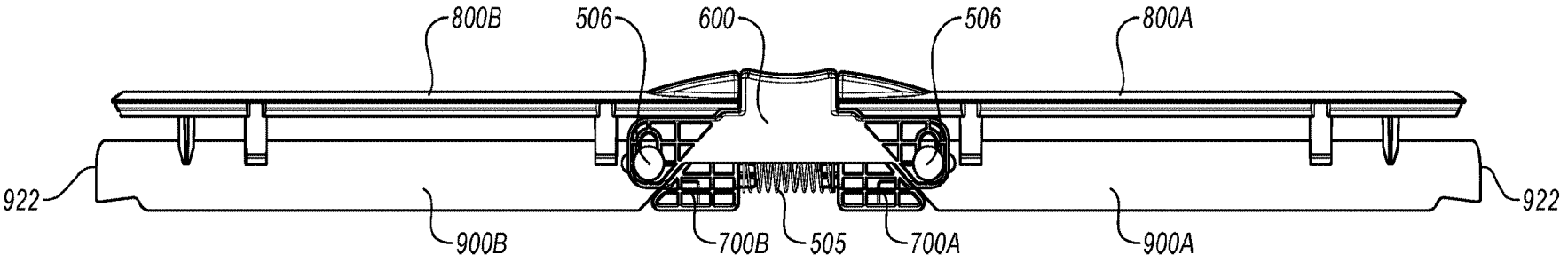
FIG. 4A is a partially cutaway side view of an exemplary leg height adjustment mechanism that may be implemented in the crossbar assembly of FIG. 3A, illustrating the crossbar in the inactive configuration.
Figure 4B:
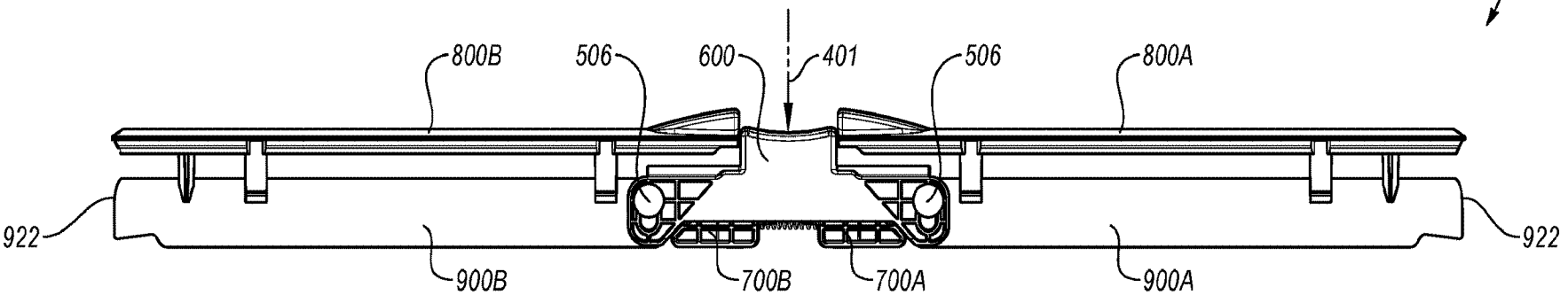
FIG. 4B illustrates the height adjustment mechanism of FIG. 4A in the active configuration.
Figure 5A:
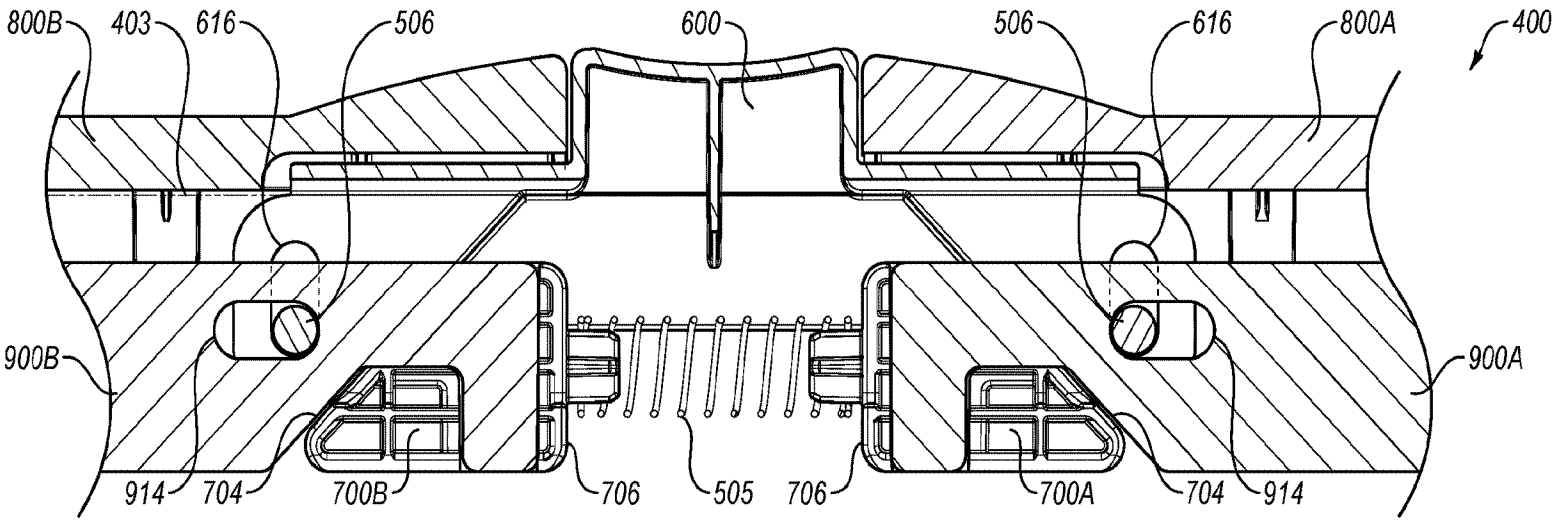
FIG. 5A is an enlarged, partially cutaway, detailed view of a portion of the height adjustment mechanism of FIG. 4A in the inactive configuration.
Figure 5B:
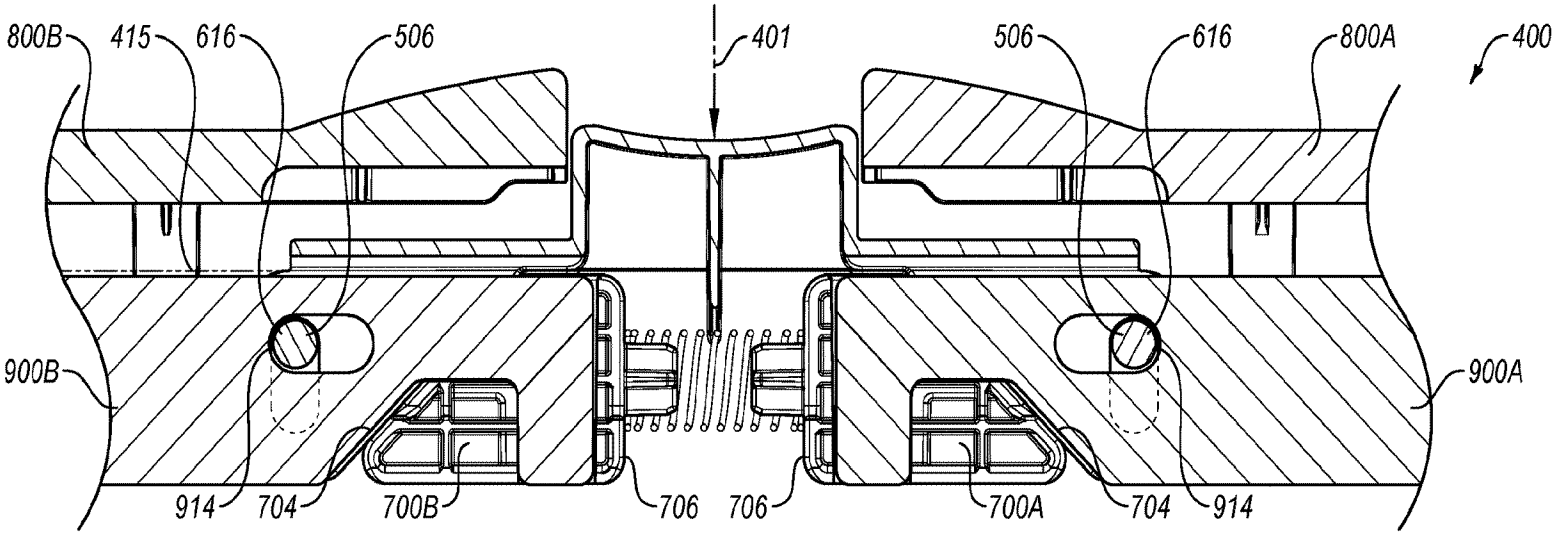
FIG. 5B is an enlarged, partially cutaway, detailed view of the portion of the height adjustment mechanism of FIG. 5A in the active configuration.

FIG. 4A is an exemplary embodiment of the height adjustment mechanism 400 that may be implemented in the crossbar assembly 300 of FIG. 3A in an inactive configuration. FIG. 4A is described herein with FIG. 5A. FIG. 5A is a detailed view of a portion of the height adjustment mechanism 400 in the inactive configuration. FIG. 5A is a sectional view of the portion of the height adjustment mechanism 400. FIG. 4B is the height adjustment mechanism 400 in an active configuration. FIG. 4B is described herein with FIG. 5B. FIG. 5B is a detailed view of a portion of the height adjustment mechanism 400 in the active configuration. FIG. 5B is also a sectional view of the portion of the height adjustment mechanism 400.

With reference to FIGS. 4A-5B, the height adjustment mechanism 400 may include one or more mechanism components such as an activator 600, retractors 700A and 700B (generally, retractor 700 or retractors 700), a biasing member such as a spring 505, one or more pins 506, and the latch arms 900A and 900B (generally, latch arms 900 or latch arm 900). Additionally, in FIGS. 4A and 4B, the height adjustment mechanism 400 is depicted with the upper crossbar portions 800A and 800B.

In the height adjustment mechanism 400, the retractors 700 may each include a sloped surface 704, a longitudinal surface 706, and a receiving structure 702. The latch arms 900 may each include an engagement structure 906 that may be engaged with or capable of being engaged with the receiving structure 702 of one of the retractors 700. The latch arms 900 may extend in lateral directions from the retractors 700. For instance, a first latch arm 900A may extend from a first retractor 700A in a lateral direction that corresponds to the positive x-direction of FIGS. 4A and 5A. Similarly, a second latch arm 900B may extend from a second retractor 700B in a lateral direction that corresponds to the negative x-direction of FIGS. 4A and 5A.

The first retractor 700A may be positioned relative to the second retractor 700B such that the longitudinal surface 706 of the first retractor 700A faces the longitudinal surface 706 of the second retractor 700B. The spring 505 may be positioned between the longitudinal surface 706 of the first retractor 700A and the longitudinal surface 706 of the second retractor 700B. The spring 505 may be configured to impose a spring force that separates the first retractor 700A from the second retractor 700B.

The activator 600 may include angled lower surfaces 612. The activator 600 may be positioned relative to the retractors 700 such that the angled lower surfaces 612 are positioned outwardly relative to the sloped surfaces 704. For instance, the retractors 700 may be positioned such that the sloped surfaces 704 are between the angled lower surfaces 612. The angled lower surfaces 612 may be configured to contact the sloped surfaces 704. In particular, the angled lower surfaces 612 may be configured to contact the sloped surfaces 704 such that longitudinal translation or movement of the activator 600 affects lateral translation of the retractors 700. For instance, responsive to a longitudinal translation or movement of the activator 600 due to a force sufficient to overcome the spring force, the retractors 700 may be drawn towards one another in a lateral direction (e.g., the x-direction and negative x-direction). Similarly, responsive to the spring force that acts to separate the retractors 700 in the lateral direction, the activator 600 may be translated in the longitudinal direction (e.g., the y-direction).

In FIGS. 4A and 5A, the height adjustment mechanism 400 is in the inactive configuration. In the inactive configuration, the activator 600 may not be subject to a force or may be subject to a force that has a magnitude insufficient to transition the activator 600 to the active position (described below with reference to FIGS. 4B and 5B). In the inactive configuration, the activator 600 is in an inactive position. In the inactive position, the activator 600 is at a first longitudinal position 403 relative to the retractors 700. In the inactive position, the retractors 700 may be translated or positioned outwardly. For instance, the first retractor 700A may be translated in the positive x-direction and the second retractor 700B may be translated in the negative x-direction of FIGS. 4A and 5A.

Outward translation of the retractors 700 may result in an outward translation of the latch arms 900. For instance, the first retractor 700A may be engaged with the first latch arm 900A. Translation of the first retractor 700A in the positive x-direction may result in translation of the first latch arm 900A in the positive x-direction. Similarly, the second retractor 700B may be engaged with the second latch arm 900B. Translation of the second retractor 700B in the negative x-direction may result in translation of the second latch arm 900B in the negative x-direction. Translation of the latch arms 900 may result in latch portions 922 of the latch arms 900 extending from openings of a crossbar assembly, which may engage latch openings (e.g., 228A and/or 228B of FIGS. 2A-2C).

In FIGS. 4B and 5B, the height adjustment mechanism 400 is in the active configuration. In the active configuration, the activator 600 may be subject to a force 401 that has a magnitude insufficient to overcome the spring force imposed by the spring 505. In the active configuration, the activator 600 is in an active position. In the active position, the activator 600 may be disposed at a second longitudinal position 405 relative to the retractors 700. The second longitudinal position 405 may be closer to the retractors 700 and farther from the upper crossbar portions 800.

In the active position, the retractors 700 may be translated inwardly. For instance, the first retractor 700A may be translated in the negative x-direction and the second retractor 700B may be translated in the positive x-direction of FIGS. 4B and 5B. Inward translation of the retractors 700 may result in an inward translation of the latch arms 900. For instance, the first retractor 700A may be engaged with the first latch arm 900A. Translation of the first retractor 700A in the negative x-direction may result in translation of the first latch arm 900A in the negative x-direction. Similarly, the second retractor 700B may be engaged with the second latch arm 900B. Translation of the second retractor 700B in the positive x-direction may result in translation of the second latch arm 900B in the positive x-direction. Translation of the latch arms 900 may result in latch portions 922 of the latch arms 900 being drawn into a crossbar assembly via openings, which may disengage the latch portions 922 from latch openings (e.g., 228A and 228B of FIGS. 2A-2C). While the latch portions 922 are disengaged from the latch openings, a lower leg may be retracted or extended. When the lower leg is retracted or extended to a desired length, the force 401 may be removed or reduced, which may transition the height adjustment mechanism 400 to the inactive configuration. In the inactive configuration, the latch portions 922 may be engaged in the latch openings.

As best depicted in FIGS. 5A and 5B, in the exemplary embodiment, the activator 600 may include two longitudinal pin apertures 616. In addition, in these and other embodiments, the latch arms 900 may each include a lateral pin aperture 914. The lateral pin apertures 914 may partially overlap one of the two longitudinal pin apertures 616. The pins 506 may be positioned in one of the longitudinal pin apertures 616 and one of the lateral pin apertures 914. The pins 506 may limit motion of the activator 600 to a substantially longitudinal direction (e.g., the y-direction) and limit motion of the latch arms 900 to a substantially lateral direction (e.g., the x-direction).

Figure 6A:
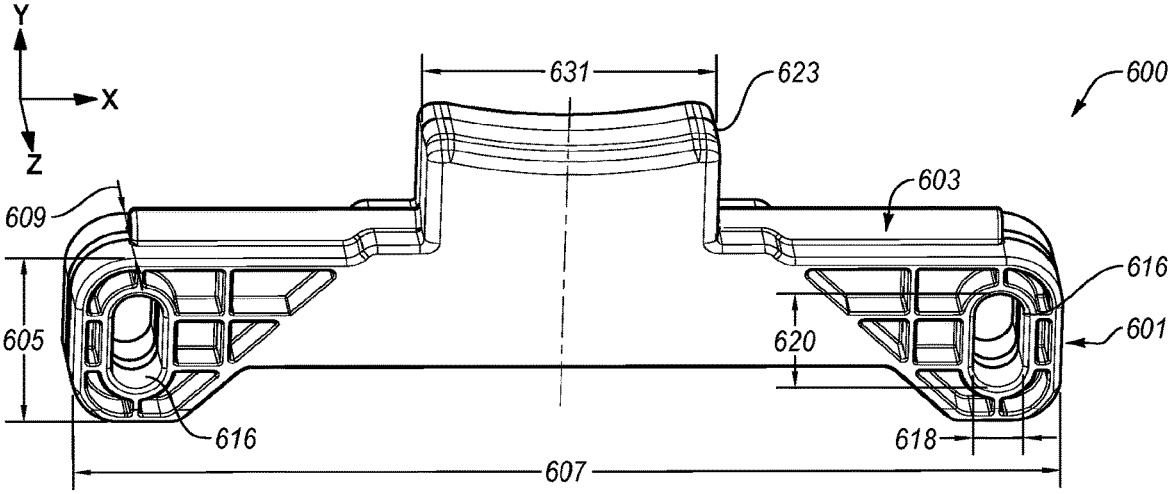
FIG. 6A is an enlarged, upper perspective view of an exemplary activator that may be implemented in the height adjustment mechanism of FIG. 4A.
Figure 6B:
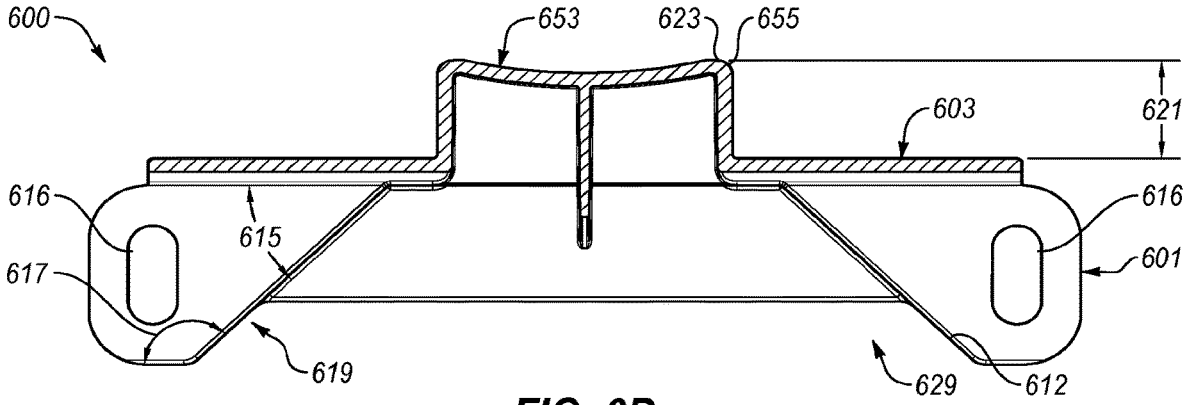
FIG. 6B is a sectional view of the activator of FIG. 6A.
Figure 6C:
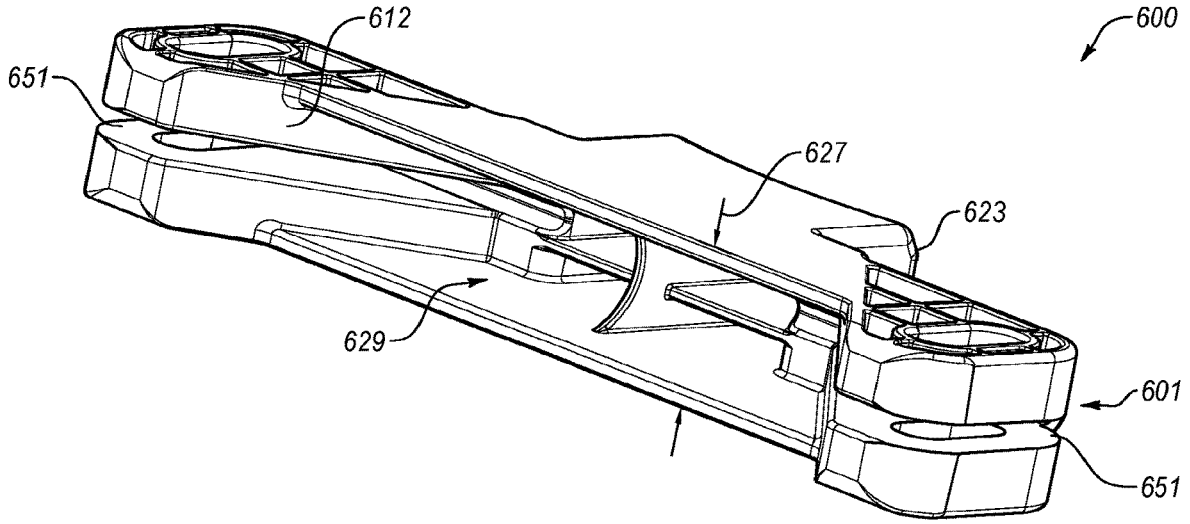
FIG. 6C is a lower perspective view of the activator of FIG. 6A.

FIGS. 6A-6C illustrate an exemplary embodiment of the activator 600 that may be implemented in the height adjustment mechanism 400 of FIG. 4A. FIG. 6A is an exterior perspective view of the activator 600. FIG. 6B is a sectional view of the activator 600. FIG. 6C is a lower perspective view of the activator 600.

Referring to FIG. 6A, the activator 600 may include a generally rectangular structure 601 with a protrusion 623 that may extend from an upper surface 603 of the rectangular structure 601. The rectangular structure 601 may include an activator length 607, an activator thickness 609, and an activator height 605. The protrusion 623 may be positioned in a central portion of the activator length 607. For example, a center of the protrusion 623 in a longitudinal direction may correspond to the center of the activator length 607. A protrusion length 631 may be less than the activator length 607. For example, the protrusion length 631 may be about one-half, about one-quarter, about one-third, about one-fifth, or another suitable proportion of the activator length 607.

The protrusion 623 may extend across all or a majority of the activator thickness 609. The activator thickness 609 may correspond to a width of a cavity defined in a crossbar housing into which the activator 600 may be disposed. For example, with reference to FIG. 3A, the crossbar housing 301 may define a mechanism cavity in which the height adjustment mechanism 400 may be disposed or at least partially disposed. The mechanism cavity may include a width that corresponds to or may be substantially equal to the activator thickness 609. Accordingly, the activator thickness 609 may be secured or retained in the mechanism cavity of the crossbar assembly 300.

The activator height 605 may be related to a height of the cavity defined in a crossbar housing into which the activator 600 may be disposed. For example, with reference to FIGS. 6A and 3A, the crossbar housing 301 may define the mechanism cavity in which the height adjustment mechanism 400 may be disposed or at least partially disposed. The mechanism cavity may include a height that is greater than activator height 605. Accordingly, the activator 600 may translate in a longitudinal direction within the crossbar housing. For instance, a user may press on the protrusion 623, which may allow the activator 600 to translate within the mechanism cavity. As described in the present disclosure, the activator 600 may be in an active position and an inactive position. In the active position, a force substantially oriented in the longitudinal direction may be applied to the protrusion 623, which may result in a translation or movement of the activator 600 in a negative y-direction. In the inactive position, the force may be removed from the protrusion 623, which may result in a translation or movement of the activator 600 in a positive y-direction.

Referring to FIGS. 6A and 6B, the activator 600 may include two longitudinal pin apertures 616. The longitudinal pin apertures 616 may include a rounded rectangular aperture. The longitudinal pin apertures 616 may include a lateral dimension 618, which may be less than a longitudinal dimension 620. The longitudinal dimension 620 may correspond to or be substantially equivalent to a dimension of a pin (e.g., the pin 506) that may be disposed in the longitudinal pin apertures 616. The lateral dimension 618 may correspond to a distance in which the activator 600 translates responsive to force imposed on the protrusion 623. The longitudinal pin apertures 616 may limit motion of the activator 600 to motion that is in a substantially longitudinal direction. For example, the longitudinal pin apertures 616 may prevent or substantially prevent motion of the activator 600 in the lateral direction.

With reference to FIGS. 6B and 6C, the activator 600 may define a cavity 629. The cavity 629 may include a cavity width 627 (FIG. 6C). The cavity width 627 may be sized to receive portions of retractors. Some details of the cavity width 627 are provided elsewhere in the present disclosure. Lateral edges of the cavity 629 may be the angled lower surfaces 612. The angled lower surfaces 612 may be configured to contact sloped surfaces of retractors that may be disposed in the cavity 629. For instance, with reference to FIGS. 6B, 6C, and 7B, an upper portion 722 that includes the sloped surface 704 may be disposed in the cavity 629. When the upper portion 722 is disposed in the cavity 629, the angled lower surfaces 612 may contact the sloped surfaces 704. Accordingly, a force, such as the force imposed on the protrusion 623 in a longitudinal direction, may be transferred from the activator 600 to the retractor 700. The force in the longitudinal direction may result in lateral translation of the retractor 700. Similarly, a spring force, which may be a lateral force, imposed on the angled lower surfaces 612 by the retractor 700 may result in longitudinal translation or movement of the activator 600.

With reference to FIG. 6B, the protrusion 623 may include a protrusion height 621. The protrusion height 621 may be defined between an upper surface 603 of the rectangular structure 601 and an upper surface 653 or portion thereof of the protrusion 623. For instance, in the depicted embodiment, the protrusion 623 may include a concave upper surface 653. In these and other embodiments, the protrusion height 621 may be defined between the upper surface 603 of the rectangular structure 601 and the upper surface 653 at an end 655.

The protrusion height 621 may correspond to a height of an arced, rounded, or curved protrusion on a crossbar assembly or crossbar housing. In particular, the protrusion height 621 may be sized such that the arced protrusion gradually or consistently interfaces with the upper surface 653 of the protrusion 623. For instance, with reference to FIGS. 6B and 8, the protrusion height 621 may be sized in relation to a height 810 of an arced protrusion 802 at a second end 806. The protrusion height 621 may be sized such that when the second end 806 is positioned immediately adjacent to the protrusion 623, the surface of the arced protrusion 802 transitions to the upper surface 653 without or with minimal interruption. A benefit of such a transition may include prevention or reduction in incidental actuation of the activator 600. Moreover, the transition may reduce or prevent damage to the protrusion 623 through items hitting the protrusion 623. A view of the protrusion 623 assembled with the arced protrusion 802 is provided in at least FIGS. 4A and 3B.

With reference to FIGS. 6A and 6C, in the depicted embodiment, the activator 600 may include arm channels 651 that extend from the cavity 629. The arm channels 651 may be configured to enable latch arms engaged with retractors (e.g., the retractors 700 described elsewhere in the present disclosure) and to extend from the cavity 629. In addition, the arm channels 651 may enable latch arms with pin apertures which may be aligned with the longitudinal pin apertures 616. For instance, with combined reference to FIGS. 6A, 6C, and 9, the latch arm 900 may include lateral pin apertures 914. The latch arm 900 may be disposed at least partially in one of the arm channels 651. When disposed therein, the lateral pin apertures 914 may be aligned with the longitudinal pin apertures 616 such that there is some overlap. A pin (e.g., the pin 506) may then be positioned in the lateral pin apertures 914 and the longitudinal pin apertures 616.

FIGS. 7A-7C illustrate an exemplary embodiment of the retractor 700 that may be implemented in the height adjustment mechanism 400 of FIG. 4A. FIG. 7A is a sectional view of the retractor 700. FIG. 7B is a perspective view of the retractor 700. FIG. 7C is a side view of the retractor 700.

With combined reference to FIGS. 7A-7C, the retractor 700 may include sloped surface 704, a longitudinal surface 706, a bottom surface 707, and a receiving structure 702. The sloped surface 704 may be opposite the longitudinal surface 706. The longitudinal surface 706 may be substantially oriented in a longitudinal direction, which corresponds to the y-direction of FIG. 7A.

In some embodiments, when the retractor 700 is assembled into a height adjustment mechanism such as the height adjustment mechanism 400, the retractor 700 may be oriented relative to another retractor such that the longitudinal surface 706 of the retractor 700 faces a corresponding longitudinal surface of the other retractor. For instance, the longitudinal surface 706 may be substantially oriented in the YZ plane of FIG. 7A. The sloped surface 704 may have lower x-coordinates than longitudinal surface 706 according to the coordinate system of FIG. 7A. The other retractor 700 may also be substantially oriented in the YZ plane. However, the sloped surface 704 of the other retractor 700 may have greater x-coordinates than the longitudinal surface 706 of the other retractor 700. FIG. 5B depicts two retractors 700 in which the longitudinal surfaces 706 of the retractors 700 face one another.

In the configuration in which the two retractors 700 face one another, the spring (e.g., 505 of FIG. 5A) may be disposed between the longitudinal surface 706 of the retractors 700. In particular, the spring may contact the longitudinal surfaces 706 of the retractors 700. Accordingly, a spring force, which may be caused through compression of the spring, may act on the longitudinal surfaces 706.

In the depicted embodiment, the retractor 700 may include a spring retainer 709. The spring retainer 709 may be configured to secure or partially secure the spring relative to the retractor 700. For example, in the depicted embodiment, the spring retainer 709 may protrude from the longitudinal surface 706 in a lateral direction, which corresponds to the x-direction of FIG. 7A. The spring retainer 709 may be sized to be disposed within a volume defined by the coils of the spring. The spring retainer 709 may accordingly prevent or reduce movement of the spring along the longitudinal surface 706.

In the depicted embodiment, the spring retainer 709 may include a structure that protrudes from the longitudinal surface 706 and may be configured to be introduced or disposed into the spring. In other embodiments, the spring retainer may include a circular recess created in the longitudinal surface 706 into which the spring is positioned, a fastener, or another suitable structure that limits movement of the spring. In some embodiments, the spring retainer 709 may be omitted.

The sloped surface 704 may be oriented at an angle 705 relative to the bottom surface 707. The angle 705 may correspond to an angled lower surface of an activator. For example, with reference to FIG. 6B, the angle 705 may be a supplementary angle (e.g., the sum of the angles is 180 degrees) to angle 617 and/or may be substantially equivalent to angle 615 of the activator 600. In an assembled configuration, the sloped surface 704 or a portion thereof may be in contact with the angled lower surface of the activator. Because the contact between the angled lower surface and the sloped surface 704, movement or translation of the activator in the longitudinal direction may result in translation of the retractor 700 in substantially the lateral direction.

For example, with reference to FIG. 7A, a substantially normal force 701 or a force with a normal component may be applied to the sloped surface 704. For instance, the activator may impose the normal force 701 on the sloped surface 704. The normal force 701 may include a longitudinal component and a lateral component. In addition, a lateral force 703 may be applied to the longitudinal surface 706. For instance, the spring may impose the lateral force 703 against the longitudinal surface 706. In response to the normal force 701 having a magnitude sufficient for the lateral component to be greater than the lateral force 703, the retractor 700 may translate in a lateral direction, which may correspond to the positive x-direction. Also, in this circumstance, the activator may translate in a longitudinal direction that corresponds to a negative y-direction. In response to the normal force 701 having a magnitude such that the lateral component is less than the lateral force 703, the retractor 700 may translate in a lateral direction that corresponds to the negative x-direction. Also, in this circumstance, the activator may translate in a longitudinal direction that corresponds to the positive y-direction.

Translation of the retractor 700 may result in translation of a latch arm engaged in the receiving structure 702. With reference to FIGS. 7A and 7B, the receiving structure 702 may include a channel 710 that extends from the sloped surface 704 to the bottom surface 707. A width 712 of the channel 710 may be configured to receive a latch arm of a particular thickness. For instance, the width 712 may be about one-quarter inches, three-eighths inches, or another suitable width. The receiving structure 702 may include an angled portion 714 (FIG. 7A). The angled portion 714 may include a first inner longitudinal surface 750. In response to translation of the retractor 700 in the positive x-direction, the first inner longitudinal surface 750 may press against or contact an inner longitudinal surface of a latch arm engaged in the receiving structure 702. The translation of the retractor 700 may accordingly result in translation of the latch arm. For instance, with combined reference to FIGS. 7A and 9, the first inner longitudinal surface 750 of the retractor 700 may press against or contact an inner longitudinal surface 950 of a latch arm 900, which may result in translation of the retractor 700 and the latch arm 900.

Figure 9:
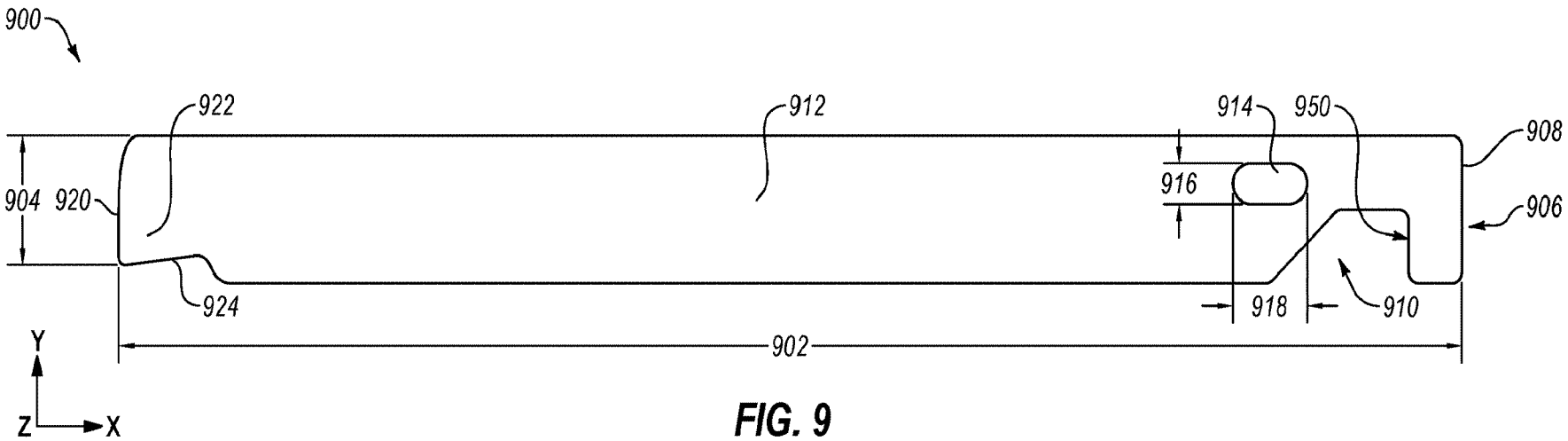
FIG. 9 is a side view of an exemplary latch arm that may be implemented in the crossbar assembly of FIG. 4A.

With continued reference to FIGS. 7A and 9, the receiving structure 702 may include a second inner longitudinal surface 752. In response to translation of the retractor 700 in the negative x-direction of FIG. 7A, the second inner longitudinal surface 752 may press against or contact an end of the latch arm 900 engaged in the receiving structure 702. For instance, the second inner longitudinal surface 752 of the retractor 700 may press against or contact a first end 908 of the latch arm 900. The translation of the retractor 700 may accordingly result in translation of the latch arm 900.

Referring to FIG. 7B, the retractor 700 may include a base 720 and an upper portion 722. A width 724 of the base 720 may be greater than a width 726 of the upper portion 722. The width 726 may correspond to a cavity configured to receive the upper portion 722. For example, the activator 600 of FIG. 6C may include a cavity 629 that includes a cavity width 627. The cavity 629 may be sized to receive the upper portion 722 of the retractor 700. Accordingly, the cavity width 627 may be somewhat larger (e.g., one-sixteenth of an inch, one-eighth of an inch) than the width 726 of the upper portion 722.

In the embodiment of FIG. 7B, the channel 710 may be defined in a central or substantially central portion of the upper portion 722. For instance, the upper portion 722 may include some material on both sides of the channel 710. In other embodiments, the channel 710 may not be central to the upper portion 722. In these and other embodiments, the upper portion 722 may not include material on both sides of the channel 710.

Figure 8:
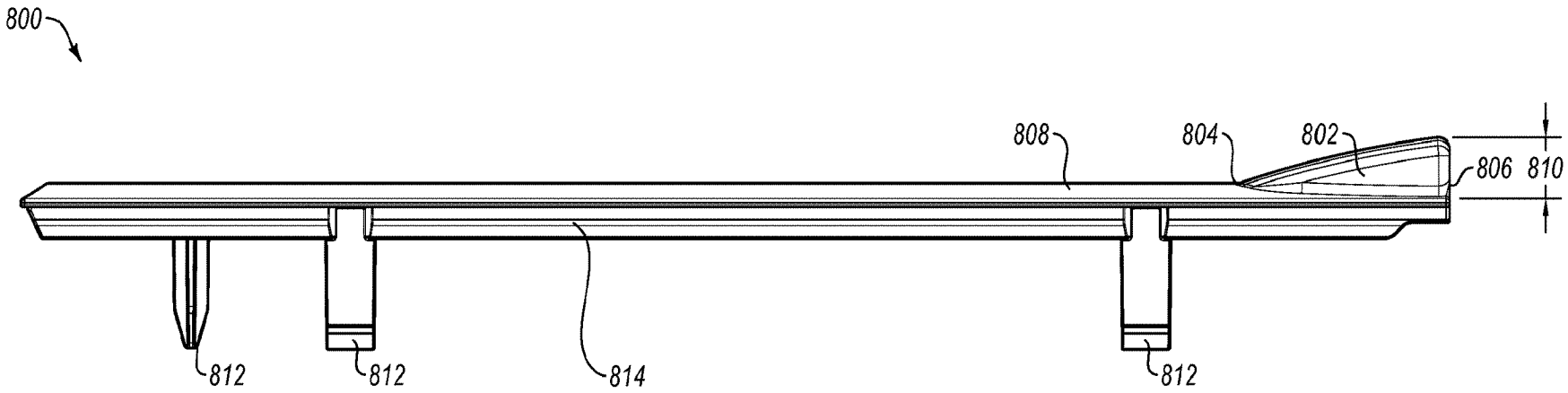
FIG. 8 is a side view of an exemplary upper portion of a crossbar housing that may be implemented in the crossbar assembly of FIG. 3A.

FIG. 8 depicts an exemplary embodiment of the upper crossbar portion 800. The upper crossbar portion 800 may be implemented in the crossbar assembly 300 of FIG. 3A in some embodiments. The upper crossbar portion 800 may be a portion of a housing of a crossbar assembly. For example, the upper crossbar portion 800 of FIG. 8 may be one side of the housing of the crossbar assembly. The housing may include another upper crossbar portion. For instance, the housing may include another substantially similar upper crossbar portion 800 on another side of the housing.

The upper crossbar portion 800 may include an upper surface 808. The upper surface 808 may be external to the crossbar assembly. The upper surface 808 may be opposite an internal feature 814 that may be configured to interface with side portions of a crossbar housing. The internal feature 814 may connect to arm retainers 812 that may guide latch arms disposed in the crossbar assembly.

The upper crossbar portion 800 may include an arced, rounded, or curved protrusion 802. The arced protrusion 802 may be included on the upper surface 808. The arced protrusion 802 may include a first end 804 and a second end 806. At the first end 804, the arced protrusion 802 may be coplanar or substantially coplanar with the upper surface 808. At the second end 806, the arced protrusion 802 may include a height 810 that is substantially equivalent to a protrusion height. For example, with reference to FIGS. 8 and 6A, the height 810 of the arced protrusion 802 may be substantially similar to the protrusion height 621. As discussed above, the arced protrusion 802 may facilitate positioning of a hand of a user on a protrusion (e.g., 623 of FIG. 6A). The arced protrusion 802 may be positioned immediately adjacent to the protrusion. For example, the second end 806 may be positioned next to and/or may abut the protrusion.

FIG. 9 illustrates an exemplary embodiment of the latch arm 900 according to at least one embodiment of the present disclosure. The latch arm 900 may generally include a strip of material. The material may include, for instance, a carbon steel or an aluminum. In other embodiments, the material may include a plastic, or a polymer, which may be coated or otherwise hardened. Additionally, the latch arm 900 of FIG. 9 may include a single, unitary, one-piece structure. In other embodiments, the latch arm 900 may be comprised of two or more sub-structures or components that may be mechanically coupled.

The latch arm 900 may include an arm length 902 that is defined in a lateral dimension, which corresponds to the x-direction of FIG. 9. The arm length 902 may be less than about half of a length of a crossbar assembly in which the latch arm 900 is implemented. For instance, the crossbar assembly may include or contain the latch arm 900, along with another latch arm that is substantially similar to the latch arm 900 and one or more additional adjustment mechanism components.

The latch arm 900 may also include an arm height 904. The arm height 904 may be defined in a longitudinal dimension, which corresponds to the y-direction of FIG. 9. The arm height 904 may be sized such that the latch arm 900 may be contained in the crossbar assembly or crossbar housing thereof. An arm thickness may be defined in the z-direction of FIG. 9. The arm thickness may be about one-quarter inches, three-eighths inches, or another suitable thickness.

The latch arm 900 may include an engagement structure 906. The engagement structure 906 may be disposed at the first end 908 of the latch arm 900. The engagement structure 906 may be configured to be engaged with a receiving structure of a retractor. For instance, the engagement structure 906 may be configured to be engaged with the receiving structure 702 of the retractor 700 of FIGS. 7A-7D. For example, in the depicted embodiment, the engagement structure 906 may include a hook-shaped projection. The hook-shaped projection may be formed through removal of a section 910 of the material of the latch arm 900. The removed section 910 of the material may have a rectangular portion that is connected to a triangular portion. The dimensions of the removed section 910 may substantially correspond to the receiving structure of the retractor. In other embodiments, the removed section 910 may include curved portions or angled portions, which may accordingly result in an engagement structure 906 with another shape.

In the depicted embodiment, when the engagement structure 906 is engaged in the receiving structure, a remaining portion 912 of the latch arm 900 may extend in the lateral direction, which may correspond to the x-direction of FIG. 9. Additionally, when the retractor is translated in the lateral direction, the retractor or a portion thereof may contact an inner longitudinal surface 950. The retractor may press against or contact the inner longitudinal surface 950 to translate the latch arm 900. For example, in an active configuration, an activator may cause translation of the retractor. The retractor may then act on the inner longitudinal surface 950 to translate the latch arm 900.

The latch arm 900 may include a latch portion 922. The latch portion 922 may be included at a second end 920 of the latch arm 900 that is opposite the first end 908 on the latch arm 900. The latch portion 922 may include a sloped bottom surface 924. The sloped bottom surface 924 may facilitate introduction of the latch portion 922 into a latch opening of a table leg assembly (e.g., the latch opening 228A and 228B of the upper leg 226 and/or the lower leg 230). The latch portion 922 or some part thereof may extend from a crossbar assembly when a height adjustment mechanism implementing the latch arm 900 is in the inactive configuration. Also, when the height adjustment mechanism implementing the latch arm 900 is in the active configuration, the latch portion 922 may be drawn into the crossbar assembly, which may enable retraction and extension of a lower leg relative to an upper leg.

The latch arm 900 may include a lateral pin aperture 914. The lateral pin aperture 914 may include a rounded rectangular aperture. The lateral pin aperture 914 may include a lateral dimension 918, which is greater than a longitudinal dimension 916. The longitudinal dimension 916 may correspond to or be substantially equivalent to a dimension of a pin (e.g., the pin 506) that may be disposed in the lateral pin aperture 914. The lateral dimension 918 may correspond to a distance in which the latch arm 900 translates responsive to motion of the retractor. The lateral pin aperture 914 may limit motion of the latch arm 900 to motion that is in a substantially lateral direction. For example, the lateral pin aperture 914 may prevent or substantially prevent motion of the latch arm 900 in the longitudinal direction.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A height adjustment mechanism, the height adjustment mechanism comprising:

a first latch arm including a first engagement structure;

a first retractor including a first sloped surface and a first receiving structure, the first receiving structure and the first engagement structure connecting the first latch arm and the first retractor;

a second latch arm including a second engagement structure;

a second retractor including a second sloped surface and a second receiving structure, the second receiving structure and the second engagement structure connecting the second latch arm and the second retractor;

an activator including a first angled surface and a second angled surface, the first angled surface of the activator contacting the first sloped surface of the first retractor, the second angled surface of the activator contacting the second sloped surface of the second retractor, the first sloped surface of the first retractor and the second sloped surface of the second retractor being at least partially disposed between the first angled surface and the second angled surface of the activator;

a first longitudinal opening of the activator;

a second longitudinal opening of the activator, the first angled surface of the activator and the second angled surface of the activator being at least partially disposed between the first longitudinal opening of the activator and the second longitudinal opening of the activator; and a biasing member disposed between the first retractor and the second retractor, the biasing member sized and configured to bias the first retractor and the second retractor away from one another.

2. The height adjustment mechanism of claim 1, wherein the angled surfaces of the activator are shaped such that a translation of the activator towards the first retractor and the second retractor in a longitudinal direction causes the angled surfaces to move relative to the first sloped surface and the second sloped surface and draws the first retractor and the second retractor towards one another.

3. The height adjustment mechanism of claim 1, wherein, in an inactive position, the activator is disposed in a first longitudinal position relative to the first retractor and the second retractor, the first retractor and the second retractor being separated by a first distance; and wherein, in an active position, the activator is disposed in a second longitudinal position relative to the first retractor and the second retractor and the angled surfaces of the activator contact the first sloped surface and the second sloped surface to cause inward translation of the first retractor and the second retractor, the first retractor and the second retractor being separated by a second distance, the second distance being less than the first distance.

4. The height adjustment mechanism of claim 3, wherein at least a portion of the first retractor, at least a portion of the second retractor, at least a portion of the activator, at least a portion of the first latch arm, and at least a portion of the second latch arm are disposed in a cavity of a crossbar assembly;

wherein at least a portion of the first latch arm extends through a first opening of the crossbar assembly when the activator is in the inactive position; and wherein at least a portion of the second latch arm extends through a second opening of the crossbar assembly when the activator is in the inactive position.

5. The height adjustment mechanism of claim 4, wherein the activator includes a protrusion that extends from the cavity of the crossbar assembly.

6. The height adjustment mechanism of claim 5, wherein the crossbar assembly includes a protrusion; and wherein a height of the protrusion of the activator is generally equal to a height of the protrusion of the crossbar assembly.

7. The height adjustment mechanism of claim 1, wherein the biasing member contacts to an inner surface of the first retractor and an inner surface of the second retractor.

8. The height adjustment mechanism of claim 7, further comprising:

a first biasing member retainer on the inner surface of the first retractor; and a second biasing member retainer on the inner surface of the second retractor, the biasing member disposed between the inner surface of the first retractor and the inner surface of the second retractor.

9. The height adjustment mechanism of claim 1, further comprising two pins:

wherein the activator includes two longitudinal pin apertures;

wherein the first and second latch arms each include a lateral pin aperture that partially overlaps one of the two longitudinal pin apertures;

wherein each of the two pins is positioned in one of the longitudinal pin apertures and one of the lateral pin apertures; and wherein the pins limit motion of the activator to a substantially longitudinal direction and limit motion of the first and second latch arms to a substantially lateral direction.

10. A leg assembly that is pivotally connected to a frame and a table top, the leg assembly comprising:

a first leg subassembly including an upper leg with one or more upper latch openings and a lower leg with one or more lower latch openings, one or more of the lower latch openings being selectively aligned with one or more of the upper latch openings;

a second leg subassembly including an upper leg with one or more upper latch openings and a lower leg with one or more lower latch openings, one or more of the lower latch openings being selectively aligned with one or more of the upper latch openings;

a crossbar assembly disposed between the first leg subassembly and the second leg subassembly, the crossbar assembly including a first opening at a first end and a second opening at a second end;

a height adjustment mechanism at least partially contained in the crossbar assembly, the height adjustment mechanism comprising:

a first retractor including a first sloped surface and a first receiving structure;

a second retractor including a second sloped surface and a second receiving structure;

a first latch arm including a first engagement structure that is engaged with the first receiving structure of the first retractor;

a second latch arm including a second engagement structure that is engaged with the second receiving structure of the second retractor; and an activator including a first angled surface, a second angled surface, a first longitudinal opening, and a second longitudinal opening, the first angled surface of the activator contacting the first sloped surface of the first retractor, the second angled surface of the activator contacting the second sloped surface of the second retractor, the first sloped surface of the first retractor and the second sloped surface of the second retractor being at least partially disposed between the first angled surface and the second angled surface of the activator, the first angled surface and the second angled surface of the activator being at least partially disposed between the first longitudinal opening and the second longitudinal opening, the activator being configurable in an inactive position to enable the first latch arm and second latch arm to extend from the first opening and the second opening of the crossbar assembly, and in an active position in which the angled surfaces contact the first sloped surface and the second sloped surface to cause inward translation of the first retractor and the second retractor such that the first latch arm and the second latch arm are drawn into the crossbar assembly via the first and second openings.

11. The leg assembly of claim 10, wherein the crossbar assembly is coupled to the first upper leg and the second upper leg such that the first opening of the crossbar assembly is aligned with a first upper latch opening of the one or more upper latch openings of the first upper leg and the second opening of the crossbar assembly is aligned with a first upper latch opening of the one or more upper latch openings of the second upper leg.

12. The leg assembly of claim 10, wherein the activator includes a protrusion that extends outwardly from the crossbar assembly.

13. The leg assembly of claim 12, wherein the protrusion of the activator includes a height;

wherein the crossbar assembly includes two protrusions; and wherein each of the two protrusions include an end that is substantially coplanar with an end of the protrusion of the activator when the activator is in the inactive position.

14. The leg assembly of claim 10, further comprising a biasing member:

wherein the first retractor includes a longitudinal inner surface;

wherein the second retractor includes a longitudinal inner surface;

wherein the biasing member is positioned between the longitudinal inner surface of the first retractor and the longitudinal inner surface of the second retractor; and wherein the biasing member is sized and configured to apply a force that separates the first retractor and the second retractor.

15. The leg assembly of claim 10, wherein the height adjustment mechanism further comprises two pins:

wherein the activator includes two longitudinal pin apertures;

wherein the first latch arm and the second latch arm each includes a lateral pin aperture that partially overlaps one of the two longitudinal pin apertures;

wherein each of the two pins is positioned in one of the longitudinal pin apertures and one of the lateral pin apertures; and wherein the pins limit motion of the activator to a substantially longitudinal direction and limit motion of the first and second latch arms to a substantially lateral direction.

16. A folding table comprising:

a tabletop that is movable between a folded position and an unfolded position, the tabletop comprising:

a first tabletop section; and a second tabletop section, the first tabletop section and the second tabletop section generally aligned in the same plane when the tabletop is in the unfolded position, and the first tabletop section and the second tabletop section disposed generally adjacent and parallel to each other when the tabletop is in the folded position;

a frame connected to the tabletop, the frame comprising:

a first side rail including a first rail section connected to the first tabletop section and a second rail section connected to the second tabletop section; and a second side rail including a first rail section connected to the first tabletop section and a second rail section connected to the second tabletop section;

a leg assembly pivotally coupled to the frame, the leg assembly comprising:

a cross member connected to the first rail section of the first side rail and the first rail section of the second side rail;

a first leg subassembly connected to the cross member, the first leg subassembly including an upper leg with one or more upper latch openings and a lower leg with one or more lower latch openings, the one or more upper latch openings being selectively aligned with one or more of the lower latch openings;

a second leg subassembly connected to the cross member, the second leg subassembly including an upper leg with one or more upper latch openings and a lower leg with one or more lower latch openings, the one or more upper latch openings being selectively aligned with one or more of the lower latch openings; and a crossbar assembly disposed between the first leg subassembly and the second leg subassembly; and a height adjustment mechanism comprising:

a first retractor including a first sloped surface and a first receiving structure;

a second retractor including a second sloped surface and a second receiving structure;

a first latch arm including a first engagement surface that is engaged with the first receiving structure of the first retractor;

a second latch arm including a second engagement surface that is engaged with the second receiving structure of the second retractor;

a spring disposed between the first retractor and the second retractor, the spring sized and configured to apply a spring force separating the first retractor and the second retractor away from one another; and an activator including one or more angled surfaces, the angled surfaces being sized and configured to contact the first sloped surface of the first retractor and the second sloped surface of the second retractor, the first sloped surface of the first retractor and the second sloped surface of the second retractor being at least partially disposed between the angled surfaces of the activator, the activator including a first elongated opening and a second elongated opening, the angled surfaces of the activator disposed between the first and second elongated openings.

17. The folding table of claim 16, wherein, when the activator is in an inactive position, the first latch arm and second latch arm extend from a first opening of the crossbar assembly and a second opening of the crossbar assembly, respectively; and the activator, in an active position, causes inward translation of the first retractor and the second retractor such that the first latch arm and the second latch arm are drawn into the crossbar assembly.

18. The folding table of claim 16, wherein the crossbar assembly is connected to the first upper leg and the second upper leg such that the first opening of the crossbar assembly is aligned with a first upper latch opening of the one or more upper latch openings of the first upper leg and the second opening of the crossbar assembly is aligned with a first upper latch opening of the one or more upper latch openings of the second upper leg.

19. The folding table of claim 16, wherein the activator includes a protrusion that extends outwardly from the crossbar;

wherein the crossbar assembly includes two protrusions; and wherein each of the protrusions of the crossbar assembly includes an end that is substantially coplanar to an end of the protrusion of the activator when the activator is in an inactive position.

20. The folding table of claim 16, wherein the height adjustment mechanism further comprises two pins;

wherein the activator includes two pin apertures;

wherein the first latch arm and the second latch arm each includes a lateral pin aperture that partially overlaps one of the two pin apertures of the activator;

wherein each of the two pins is positioned in one of the pin apertures and one of the lateral pin apertures; and wherein the pins limit motion of the activator to a substantially longitudinal direction and limit motion of the first and second latch arms to a substantially lateral direction.

* * * * *